US009471009B2

(12) United States Patent
Kikuchi et al.

(10) Patent No.: US 9,471,009 B2
(45) Date of Patent: Oct. 18, 2016

(54) DEVELOPER CONTAINER, DEVELOPER REPLENISHER, AND IMAGE FORMING APPARATUS

(71) Applicants: Teppei Kikuchi, Kanagawa (JP); Hideki Kosugi, Kanagawa (JP); Tatsuya Kubo, Kanagawa (JP); Shinnosuke Koshizuka, Kanagawa (JP); Kazunori Suzuki, Kanagawa (JP); Atsushi Nakamoto, Kanagawa (JP)

(72) Inventors: Teppei Kikuchi, Kanagawa (JP); Hideki Kosugi, Kanagawa (JP); Tatsuya Kubo, Kanagawa (JP); Shinnosuke Koshizuka, Kanagawa (JP); Kazunori Suzuki, Kanagawa (JP); Atsushi Nakamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/642,003

(22) Filed: Mar. 9, 2015

(65) Prior Publication Data

US 2015/0261134 A1 Sep. 17, 2015

(30) Foreign Application Priority Data

Mar. 11, 2014 (JP) ..... 2014-047857
Jun. 26, 2014 (JP) ..... 2014-131869

(51) Int. Cl.
*G03G 15/08* (2006.01)

(52) U.S. Cl.
CPC ..... *G03G 15/0889* (2013.01); *G03G 15/087* (2013.01); *G03G 15/0865* (2013.01); *G03G 15/0836* (2013.01); *G03G 2215/085* (2013.01)

(58) Field of Classification Search
CPC ..... G03G 15/0872; G03G 15/0836; G03G 15/0837; G03G 15/087
USPC ..... 399/262–263
See application file for complete search history.

(56) References Cited

U.S. PATENT DOCUMENTS 6,301,461 B1 * 10/2001 Sirejacob ..... G03G 15/09 399/274
6,456,810 B1 9/2002 Deguchi et al.
2001/0046395 A1 * 11/2001 Ashikari ..... G03G 15/0877 399/262

(Continued)

FOREIGN PATENT DOCUMENTS

JP 2002-6613 A 1/2002
JP 2005-134694 5/2005
WO WO 2013/101407 A1 7/2013

OTHER PUBLICATIONS

Extended European Search Report issued on Aug. 13, 2015 in the corresponding European Application No. 15157683.2.

*Primary Examiner* — Christopher Mahoney
(74) *Attorney, Agent, or Firm* — Oblon, McClelland, Maier & Neustadt, L.L.P.

(57) ABSTRACT

A developer container includes a container body, a rotary shaft, a rotary stirrer, and a flexible blade. The container body contains developer and has a discharge port. The rotary stirrer includes a rotary support and rotates about the rotary shaft to stir and transport the developer. The rotary support includes a base end rotatable integrally with the rotary shaft, a free end spaced away from an inner wall of the container body, and a holding surface provided at the free end or at a position shifted toward the rotary shaft away from the free end. The holding surface is parallel to or inclined relative to a rotation direction of the rotary support. The flexible blade includes a base end portion held on the holding surface and a distal end to contact the inner wall and transport the developer to the discharge port.

20 Claims, 26 Drawing Sheets

(56) References Cited

U.S. PATENT DOCUMENTS

2002/0025183 A1* 2/2002 Murakami ..... G03G 15/0894 399/109
2009/0087216 A1* 4/2009 Sakuma ..... G03G 15/0898 399/106
2009/0087222 A1* 4/2009 Mase ..... G03G 15/0877 399/255
2009/0087227 A1* 4/2009 Takagi ..... G03G 15/0886 399/263
2009/0274491 A1 11/2009 Sato
2011/0182616 A1 7/2011 Sato
2013/0051863 A1 2/2013 Koshizuka et al.
2013/0170873 A1* 7/2013 Carter, II ..... G03G 15/0887 399/263
2013/0243491 A1 9/2013 Nodera et al.
2013/0315636 A1 11/2013 Takayama et al.
2014/0003843 A1 1/2014 Suzuki et al.
2014/0320906 A1 10/2014 Fujimori et al.
2014/0321885 A1 10/2014 Fujimori et al.
2014/0321886 A1 10/2014 Kikuchi et al.
2015/0071685 A1* 3/2015 Ichikawa ..... G03G 15/0889 399/263
2015/0338825 A1* 11/2015 Leemhuis ..... F16D 1/06 403/348

* cited by examiner

DEVELOPER CONTAINER, DEVELOPER REPLENISHER, AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2014-047857, filed on Mar. 11, 2014, and 2014-131869 filed on Jun. 26, 2014, in the Japan Patent Office, the entire disclosure of each of which is hereby incorporated by reference herein.

BACKGROUND

1. Technical Field

Embodiments of the present disclosure relate to a developer container to contain a developer in an interior thereof, a developer replenisher including the developer container, and an electrophotographic image forming apparatus including the developer replenisher.

2. Description of the Related Art

Image forming apparatuses such as copiers, printers, facsimile machines, plotters, or multifunction peripherals having at least one of the foregoing capabilities. For example, for an electrophotographic image forming apparatus, a developer is supplied to a latent image on an image bearer by a developing device to make the latent image visible. Accordingly, since the developer in the developing device is reduced in accordance with the use, the image forming apparatus includes a developer replenisher which supplies the powder developer such as toner to the developing device. The developer replenisher includes a developer container and a mount detachably mounting the developer container. The developer container includes a container body which contains the developer and a developer transporter in an inner portion, a discharge port through which the developer is discharged to the outside of the container, and the developer transporter which transports the developer from the container body to the discharge port. Then, when the amount of the developer in the developing device is reduced, the developer replenisher rotatably drives the developer transporter using a driving unit, so that the developer in the container body is discharged to the outside of the container and supplied to the developing device.

The developer transporter includes a screw which transports the developer to the discharge port and a rotary stirrer which stirs the developer to prevent the developer from being agglomerated and transports the developer up to the screw. There is proposed a rotary stirrer which includes a rotary support which is relatively high in rigidity and rotatably provided and a flexible blade which is disposed on a side near a free end of the rotary support. While the rotary support rotates, the flexible blade comes into sliding contact with the surface of an inner wall (also referred to as a "container inner wall") of the container body, so that the developer is transported (herein, the "sliding contact" means a state of smooth contact).

SUMMARY

In at least one embodiment of the present disclosure, there is provided an improved developer container including a container body, a rotary shaft, a rotary stirrer, and a flexible blade. The container body contains developer and has a discharge port through which the developer is discharged to an outside of the container body. The rotary stirrer includes a rotary support and rotates about the rotary shaft to stir and transport the developer. The rotary support includes a base end, a free end, and a holding surface. The base end is rotatable integrally with the rotary shaft. The free end is spaced away from an inner wall of the container body. The holding surface is provided at the free end or at a position shifted toward the rotary shaft away from the free end. The holding surface is parallel to or inclined relative to a rotation direction of the rotary support. The flexible blade includes a base end portion and a distal end. The base end portion is held on the holding surface. The distal end contacts the inner wall of the container body and transports the developer to the discharge port.

In at least one embodiment of the present disclosure, there is provided an improved developer replenisher including the developer container and a mount. The developer container contains the developer to be supplied to a developing device and includes the rotary stirrer. The mount detachably mounts the developer container.

In at least one embodiment of the present disclosure, there is provided an improved an image forming apparatus including an image bearer, the developing device, and the developer replenisher. The image bearer bears a latent image thereon. The developing device develops the latent image borne on the image bearer using the developer. The developer replenisher supplies the developer to the developing device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
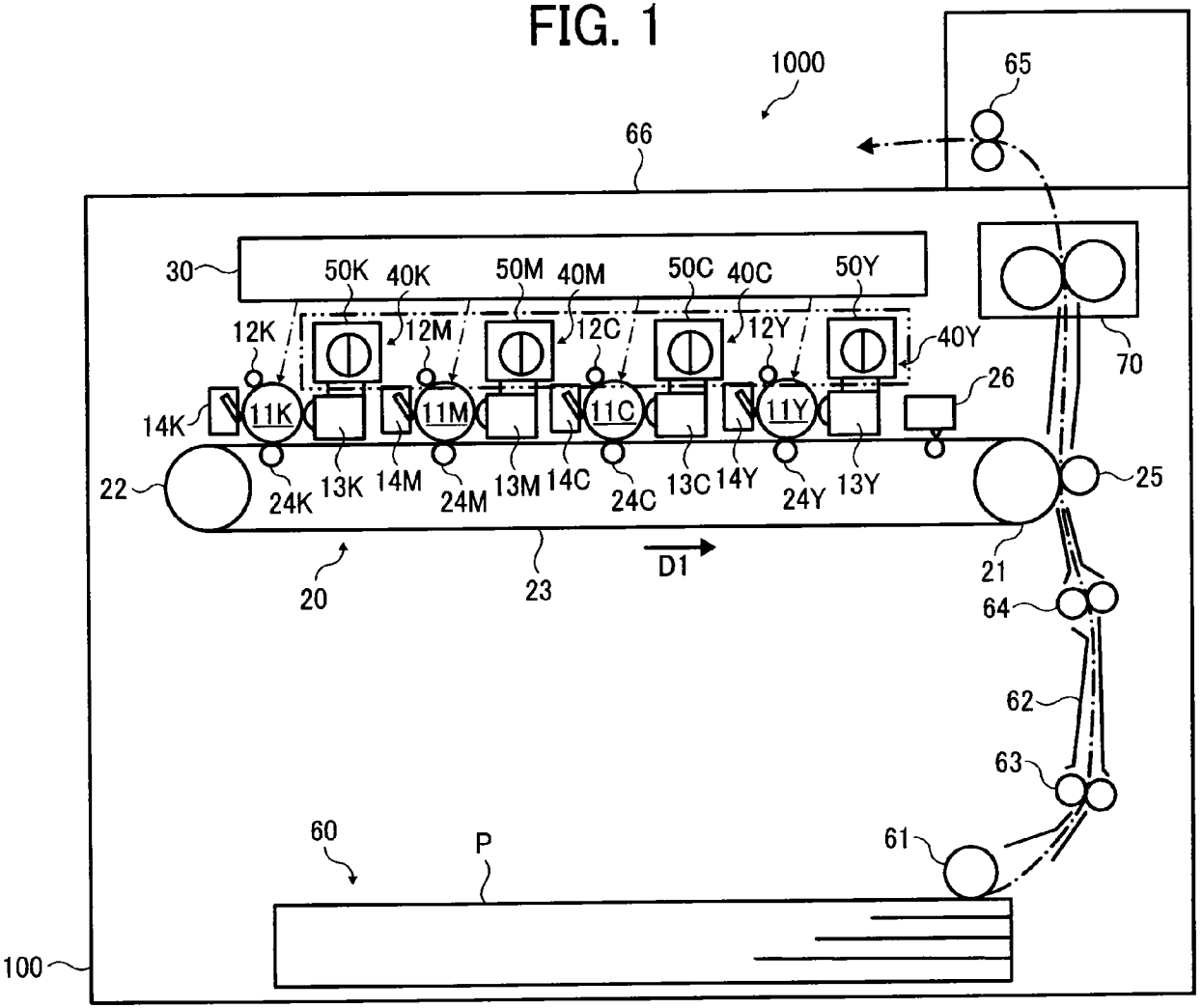
FIG. 1 is a schematic front view of an image forming apparatus according to an embodiment of the present disclosure.

The accompanying drawings are intended to depict embodiments of the present disclosure and should not be interpreted to limit the scope thereof The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Hereinafter, embodiments of the present disclosure including examples are described in detail with reference to the drawings. Elements (members or components) having the same function and shape of the respective embodiments are denoted with the same symbol as long as there is no concern about confusion, and the descriptions thereof will not be repeated. First, the entire configuration and operation of an image forming apparatus are described, and then characteristic portions according to the present disclosure are described. Regarding the characteristic portions according to the present disclosure, a comparative example according to the invention already filed by the applicant is first described in order to help with understanding on the embodiments described below, and then compared and contrasted with a conventional example to specify the object of the present disclosure.

First, an image forming apparatus according to an embodiment of this disclosure is described with reference to FIG. 1.

FIG. 1 is a schematic front view of an image forming apparatus 1000 according to an embodiment of the present disclosure. In FIG. 1, the image forming apparatus 1000 is illustrated as an electrophotographic printer to form a color image using developers of four colors (yellow, cyan, magenta, and black). In FIG. 1, the subscripts such as Y, C, M, and K attached as tags of the symbols indicate that the subject members are used for yellow, cyan, magenta, and black.

The image forming apparatus 1000 includes a transfer unit 20 serving as a transfer device inside an apparatus body 100. The transfer unit 20 includes an endless intermediate transfer belt 23 which serves as an intermediate transfer body and is wounded on a plurality of rollers 21 and 22. The intermediate transfer belt 23 is endlessly moved by a driving motor in a counterclockwise direction indicated by arrow D1 in FIG. 1. Four primary transfer rollers 24Y, 24C, 24M, and 24K serving as primary transfer members are disposed in the inner loop of the intermediate transfer belt 23 to abut on a rear surface of the intermediate transfer belt 23. A secondary transfer roller 25 as a secondary transfer member is disposed at a position facing the roller 21 on the outside of the intermediate transfer belt 23. A belt cleaning device 26 serves as a belt cleaner which cleans the surface of the intermediate transfer belt 23. A primary transfer bias is supplied from a power source to the primary transfer rollers 24Y, 24C, 24M, and 24K. A secondary transfer bias is supplied from the power source to the secondary transfer roller 25.

On the upper side of the transfer unit 20, four image forming units of colors Y, C, M, and K serving as imaging units are arranged in a belt travel direction along an upper stretched surface of the intermediate transfer belt 23. The respective image forming units include drum-shaped photoconductors 11Y, 11C, 11M, and 11K serving as image bearers, charging devices 12Y, 12C, 12M, and 12K serving as chargers, developing devices 13Y, 13C, 13M, and 13K serving as developing units. In addition, the image forming units each include drum cleaning devices 14Y, 14C, 14M, and 14K serving as photoconductor cleaners. Components thereof are integrated in each unit with a casing, and are detachably attachable with respect to the apparatus body 100. The lower portions of the peripheral surfaces of the respective photoconductors 11Y, 11C, 11M, and 11K are in contact with the upper stretched surface of the intermediate transfer belt 23 facing the primary transfer rollers 24Y, 24C, 24M, and 24K, and thus primary transfer nips for Y, C, M, and K colors are formed. The term "stretched" used herein means that an object is stretched taut between objects. The term "contact" used herein means that objects abut on each other in a protruding state.

On the upper side of the image forming unit, a writing unit 30 is disposed. The writing unit 30 drives a light source based on image data to irradiate the respective photoconductors 11Y, 11C, 11M, and 11K with the corresponding exposure light for Y, C, M, and K, and thus light irradiation is performed. Therefore, electrostatic latent images are formed in the peripheral surfaces of the respective photoconductors 11Y, 11C, 11M, and 11K which are rotated in a clockwise direction in FIG. 1.

The developing devices 13Y, 13C, 13M, and 13K store corresponding developers in which toners of Y, C, M, and K colors are contained, and supply the corresponding develops to the surfaces of the respective photoconductors 11Y, 11C, 11M, and 11K by developer bearers such as developing rollers where a developing bias is supplied. Therefore, the electrostatic latent images on the respective photoconductors 11Y, 11C, 11M, and 11K are developed, so that toner images are formed and made as visible images. In the upper portion of the developing devices 13Y, 13C, 13M, and 13K, developer replenishers 40Y, 40C, 40M, and 40K are disposed. In the developer replenishers 40Y, 40C, 40M, and 40K, developer containers 50Y, 50C, 50M, and 50K which contain replenishment developers therein are provided to be detachably attachable. Each of the developing devices 13Y, 13C, 13M, and 13K includes a toner density sensor. When the toner density sensor detects that the density of toner in developer is lower than a threshold value, a controller activates the developer replenishers 40Y, 40C, 40M, and 40K. Thus, developer in the developer containers 50Y, 50C, 50M, and 50K is replenished and supplied to the developing devices 13Y 13C, 13M, and 13K with developer replenishing units of the developer replenishers 40Y, 40C, 40M, and 40K.

On the lower side of the transfer unit 20 is disposed a sheet feeding unit 60 to contain recording materials P as sheet-type recording medium media, such sheets of paper or overhead projector (OHP) sheets. A sheet feeding roller 61 feeds a recording material P of the sheet feeding unit 60 out of the sheet feeding unit 60 toward a sheet feeding passage 62. In the sheet feeding passage 62, conveyance rollers 63 and registration rollers 64 are disposed to convey the recording material P fed out of the sheet feeding unit 60 toward a secondary transfer nip. The registration rollers 64 feed the recording material P from the sheet feeding passage 62 to the secondary transfer nip so as to synchronize with the toner image on the intermediate transfer belt 23. On the upper side from the secondary transfer nip, a fixing device 70 is disposed, and ejection rollers 65 are disposed on the downstream side in a recording-material conveyance direction from the fixing device 70.

In the image forming apparatus 1000 having such a configuration, when a color image is formed, the toner images formed on the surfaces of the photoconductors 11Y, 11C, 11M, and 11K of the respective colors are transferred onto the intermediate transfer belt 23 in a superimposing manner in the primary transfer nip. The superimposed toner images are collectively transferred onto the recording material P in the secondary transfer nip. The residual toners or paper particles remaining in the surfaces of the respective photoconductors 11Y, 11C, 11M, and 11K after transferring are removed by the drum cleaning devices 14Y, 14C, 14M, and 14K, and the residual toners or paper particles remaining in the surface of the intermediate transfer belt 23 after transferring are removed by the belt cleaning device 26. While the recording material P with the superimposed toner images transferred passes through the fixing device 70, the toner images are fixed, and the recording material P is discharged to the outside of the apparatus body 100 by the ejection rollers 65. In this example, recording materials P are ejected to the outside of the apparatus body 100 and stacked in a stacking unit 66 formed on the upper surface of the apparatus body 100.

Figure 2A:
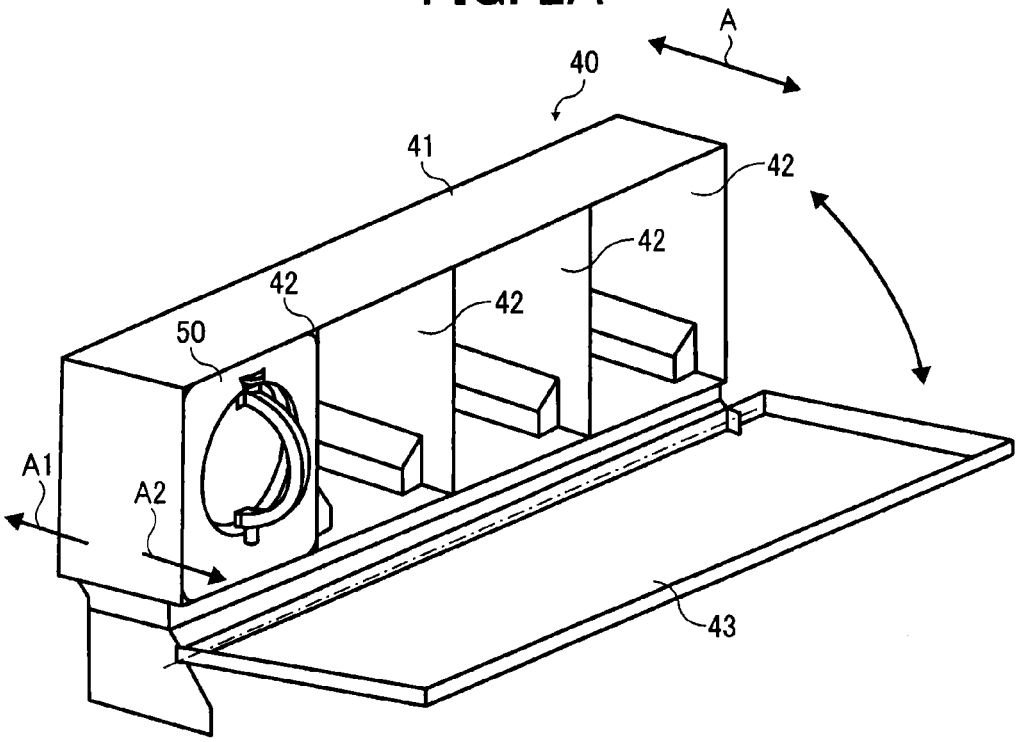
FIG. 2A is a perspective view of a developer replenisher according to an embodiment of this disclosure, in a state in which a door of the developer replenisher is open and a developer container is mount.
Figure 2B:
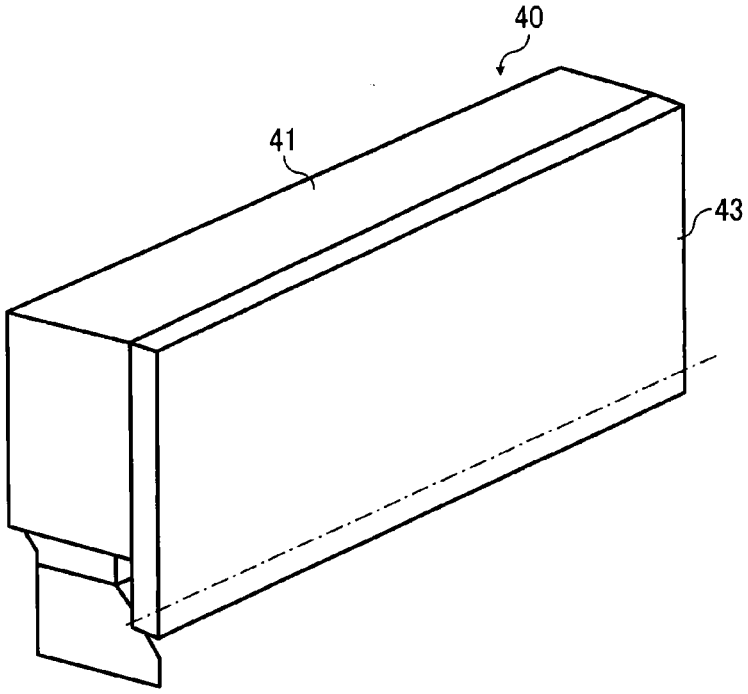
FIG. 2B is a perspective view of the developer replenisher of FIG. 2A in a state in which the door is closed.

With reference to FIGS. 2A and 2B, a configuration of the developer replenisher is described. FIGS. 2A and 2B are perspective views illustrating a schematic configuration of the developer replenisher according to an embodiment. FIG. 2A illustrates a state of the developer replenisher of which the door is opened and a mounting state of a developer container. FIG. 2B illustrates a state of the developer replenisher of which the door is closed. In the present embodiment, the developer replenishers 40Y, 40C, 40M, and 40K and the developer containers 50Y, 50C, 50M, and 50K of the respective colors have the same configuration except that the colors of the developers containing toner are different, and the common configuration is described in the following. Further, the subscripts Y, C, M, and K are omitted.

As illustrated in FIGS. 2A and 2B, the developer replenisher 40 includes the developer container 50 and a mount 41 which supports the developer container 50 to be detachably attachable, and serves to supply the developer in the developer container 50 to the developing device 13 corresponding to the color. The mount 41 includes openings 42 which are used to contain the developer containers 50, and a door 43 which opens or closes the openings 42. The mount 41 is formed to have the internal shape which is approximated to the outer shape of the developer container 50, and holds the developer container 50 to be freely moved in an attaching/detaching direction denoted by arrow A in FIG. 2A. In FIG. 2A, arrow A1 indicates an insertion direction, and arrow A2 indicates a separation direction.

FIG. 2A illustrates a configuration with openings 42 through which to accommodate the four developer containers 50, a state where one developer container 50 thereof is accommodated in the mount 41, and an open state of the door 43. FIG. 2B illustrates a closed state of the door 43, and in this state, the openings 42 are closed. The door 43 is positioned in the outer surface of the apparatus body 100 of the image forming apparatus 1000, and can be opened and closed from the outside of the apparatus body 100.

Below, a comparative example is described before a first embodiment of this example is described.

This comparative example is made to resolve a problem of a conventional art. For a toner cartridge (developer container) including a developer transporter, in order to efficiently transport the developer to the screw by the rotary stirrer and to save the developer, the developer container provided with the developer transporter is necessary to reduce a residual developer when the developer runs out and the container is exchanged. Therefore, the flexible blade is necessarily increased in rigidity to some degree, and as a result, agglomerates of the developer are easily generated by a large pressure generated in the sliding surface between the container inner wall and the flexible blade.

In the rotary stirrer as described above, there is a need to reduce the pressure generated in the sliding surface between the container inner wall and the flexible blade, and to make the rigidity of the flexible blade small in order to prevent the agglomerates of the developer. However, on the other hand, the developer is not possible to be efficiently transported by the flexible blade having a small rigidity.

In addition, when the developer container filled with the developer is delivered by a delivery system such as a truck, the bulk of the developer in the inner portion of the container becomes smaller by micro vibrations in the delivery and gravity, so that there occurs a phenomenon that a bulk density is remarkably increased. In the developer container where the phenomenon occurs, there is a concern that liquidity of the developer is degraded, the flexible blade having a small rigidity is bent before the developer is transported, and the entire developer is not possible to be transported.

Comparative Example

Next, a developer container 50 according to the comparative example of the present disclosure is described with reference to FIGS. 3 to 6B.

Figure 3:
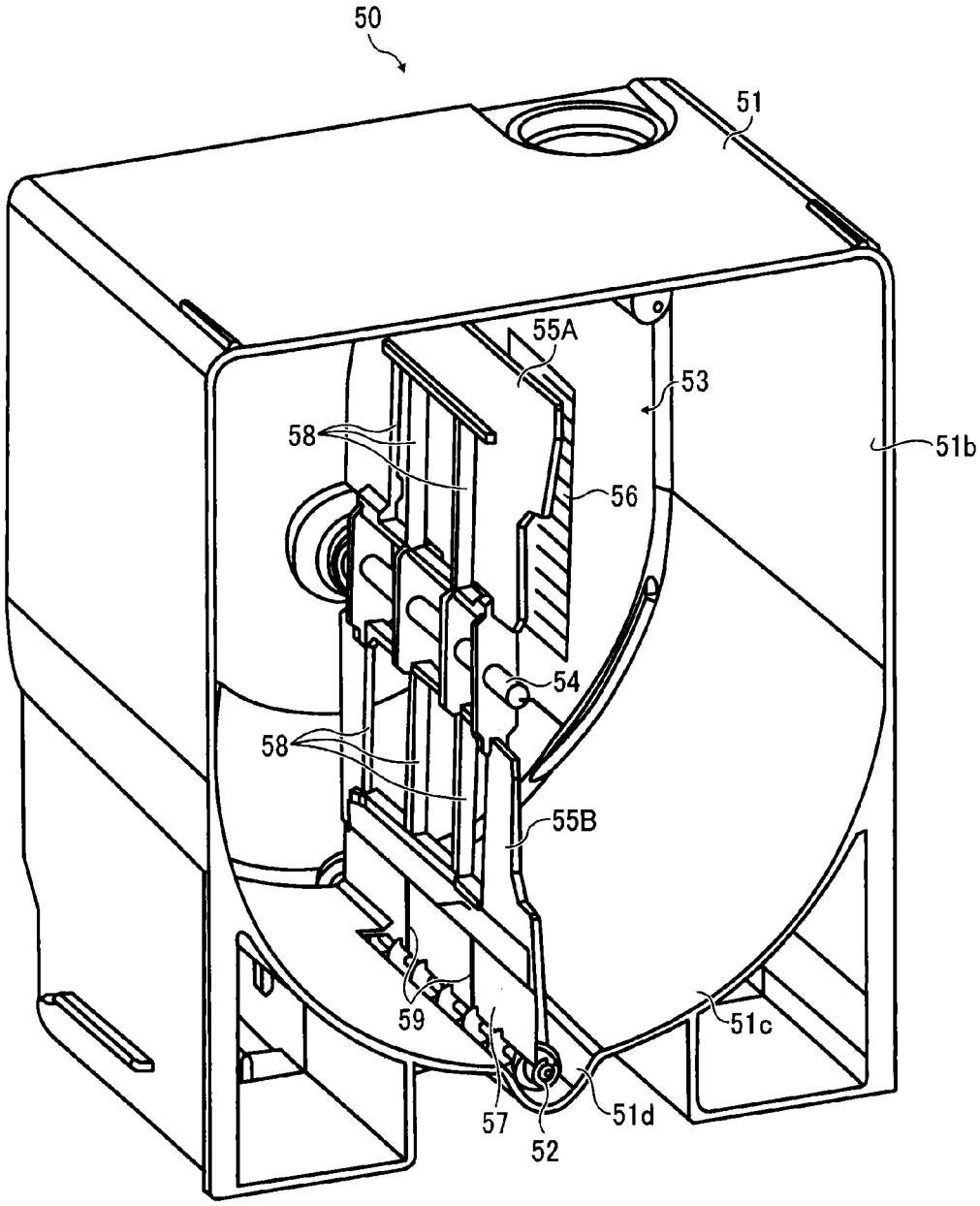
FIG. 3 is a perspective view of a configuration of a developer container according to a comparative example.
Figure 4:
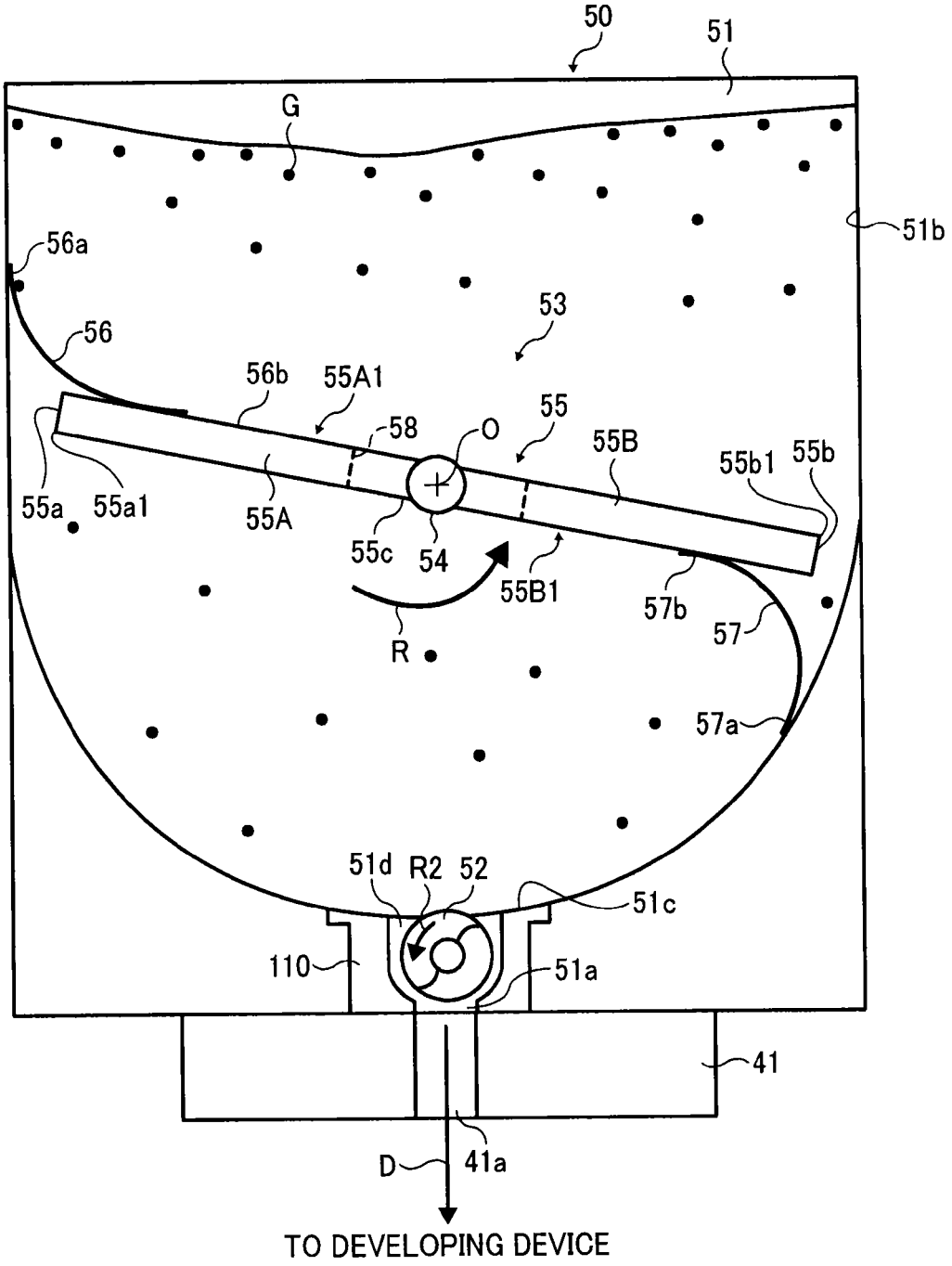
FIG. 4 is an enlarged front view of the developer container according to the comparative example.
Figure 5:
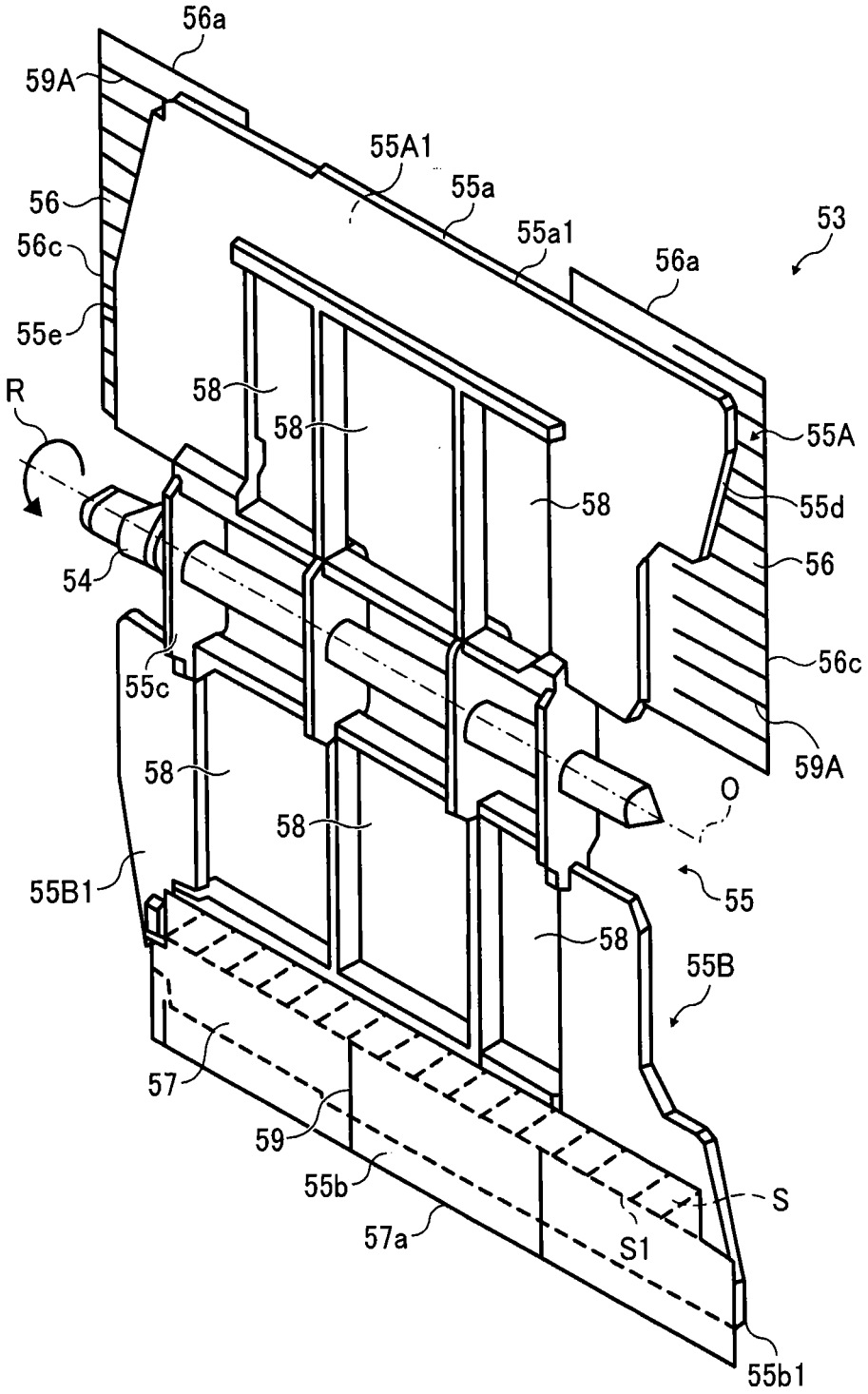
FIG. 5 is an enlarged perspective view of the rotary stirrer of FIG. 3.
Figure 6A:
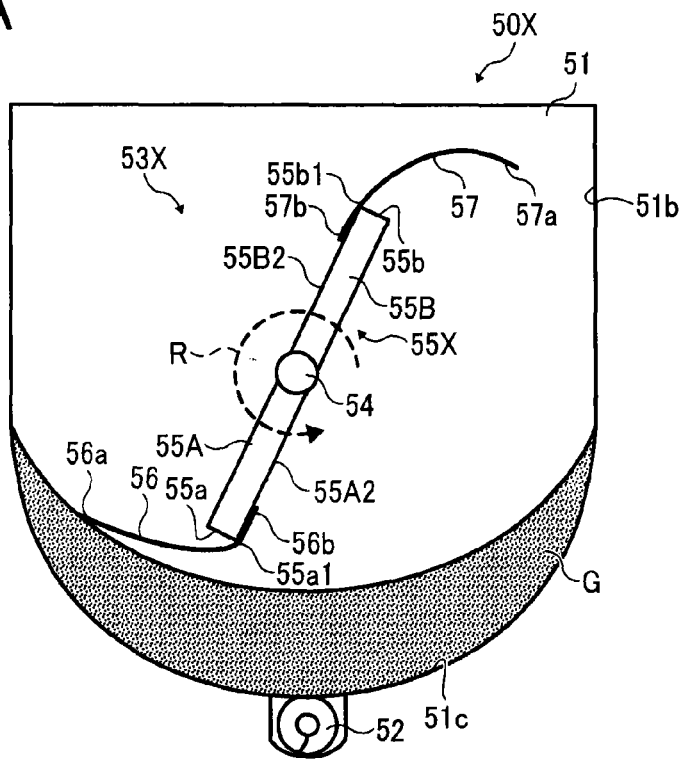
FIG. 6A is a schematic view of a rotary stirrer according to a conventional example.
Figure 6B:
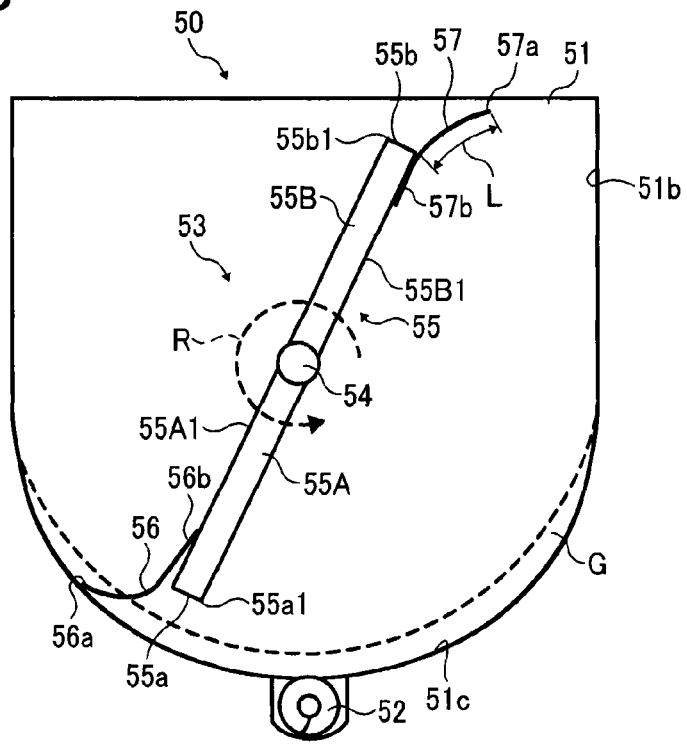
FIG. 6B is a diagram illustrating an operational effect of the comparative example of FIG. 3.

FIG. 3 is a perspective view illustrating a configuration of the developer container according to the comparative example. FIG. 4 is a cross-sectional front view illustrating the configuration of the developer container according to the comparative example. FIG. 5 is an enlarged perspective view illustrating an example of a rotary stirrer in the comparative example of FIG. 3. FIGS. 6A and 6B are diagrams for describing a problem and a function of the rotary stirrer. FIG. 6A is a diagram for describing a problem of a rotary stirrer of a conventional example. FIG. 6B is a diagram illustrating an operational effect of the comparative example.

As illustrated in FIGS. 3 and 4, the developer container 50 contains developer G and includes a container body 51, a screw 52, and a rotary stirrer 53. The container body 51 has a discharge port 51*a* through which to discharge the developer G contained in the container body 51 (hereinafter, the container body may be simply referred to as a "container"). The rotary stirrer 53 and the screw 52 stir and transport the developer G toward the discharge port 51*a*. In FIG. 3, the developer G is omitted for convenience. The rotary stirrer 53 and the screw 52 serves as a developer transporter which stirs and transports the developer G toward the discharge port 51*a*. The rotary stirrer 53 and the screw 52 are disposed in the container body 51 to be parallel with each other in a direction from the front side to the rear side relative to a sheet face on which FIG. 3 is printed. As illustrated in FIG. 4, when the developer container 50 is mounted on the mount 41 of the developer replenisher 40 illustrated in FIGS. 2A and 2B, a rotary shaft 54 is coupled with a driving assembly including a driver at the developer replenisher 40 and is rotatably driven with the driving assembly. The same goes to the screw 52. As described above, the rotary stirrer 53 and the screw 52 in the developer container 50 are rotatably driven by the driver. Thus, the rotary stirrer 53 rotates in a direction indicated by arrow R and the screw 52 rotates in a direction indicated by arrow R2 in FIG. 4. Then, the developer G is stirred by the rotation of the rotary stirrer 53, and the developer G is stirred by the rotation of the screw 52, so that the developer G in the container body 51 is discharged from the discharge port 51*a* to the outside of the container.

The container body 51 is formed in a box shape deepened in a direction (the attaching/detaching direction A illustrated in FIG. 2A) perpendicular to the sheet, and a bottom of a container inner wall 51*b* is formed in an arc-shaped surface 51*c*, the container inner walls 51*b* positioned on both sides of the arc-shaped surface 51*c* are formed in a substantially vertical direction. On one end side (the front side of the sheet face) of a discharge portion 51*d* in the direction perpendicular to the sheet face, the discharge port 51*a* which communicates with an inner portion and an outer portion of the container body 51 is formed. In an inner portion of the discharge portion 51*d*, the screw 52 which transports the developer G toward the discharge port 51*a* and is extended in the direction perpendicular to the sheet face of FIG. 3 is disposed. The developer G in the discharge portion 51*d* is transported toward the discharge port 51*a* by the screw 52 which is rotatably driven by the driver.

The rotary stirrer 53 stirs the developer G in the container body 51 to prevent the developer from being agglomerated, and transports the developer G up to the discharge portion 51*d* in which the screw 52 is disposed. The rotary stirrer 53 includes the rotary shaft 54 which is rotatably driven by the driver, and transports the developer G toward the discharge port 51*a* while stirring the developer by rotating about the rotary shaft 54 in the counterclockwise direction in FIG. 3.

In the developer container 50, a shutter 110 which opens and closes the discharge port 51*a* is mounted. The shutter 110 is configured such that the developer container 50 closes the discharge port 51*a* before being mounted in the mount 41 and is opened after being mounted in the mount 41, so that the discharge port 51*a* is opened. A transport port 41*a* is formed in the mount 41 which faces the discharge port 51*a*. When the shutter 110 is opened, the developer G discharged and falling from the discharge port 51*a* is supplied from the transport port 41*a* into the developing device 13 through a transport passage.

As illustrated in FIGS. 3 to 5, the rotary stirrer 53 includes a rotary support 55 which rotates integrally with the rotary shaft 54, and flexible blades 56 and 57. It is desirable that the rotary shaft 54 and the rotary support 55 are formed integrally with metal or resin, but another material or a manufacturing method may be used. As described above, the rotary shaft 54 and the rotary support 55 can be regarded as substantially a rigid body having a fully rigidity, and has stirring and loosening functions. The rotary shaft 54 serving as a rotation center of the rotary stirrer 53 is disposed such that the rotation center O is concentric with the arc center of the arc-shaped surface 51*c*. The rotary support 55 is a plate member including support portions 55A and 55B, and the rotary shaft 54 is integrally formed at a base end 55*c* which is positioned on a side near the center. End portions 55*a* and 55*b* which are free ends of the support portions 55A and 55B in the rotary support 55 are formed in a shape dimension to approach the container inner wall 51*b*. In other words, the end portions 55*a* and 55*b* of the support portions 55A and 55B do not abut on the container inner wall 51*b* but approach the container inner wall 51*b* so as to be disposed in the container body 51. In the base end 55*c*, an opening 58 which passes through the rotary support 55 in the rotation direction R is formed (the other openings 58 except the opening 58 formed at the base end 55*c* are not illustrated in FIG. 4). The rotary support 55 is formed by the support portions 55A and 55B which are disposed to be symmetrically about a center line (a symmetric axis) of the rotation center O of the rotary shaft 54 on both sides except the opening 58.

The flexible blades 56 and 57 are made of a so-called Mylar which is a resin material having a low rigidity, and base end portions 56*b* and 57*b* thereof are mounted and supported on the free-rotation end sides of the support portions 55A and 55B in the rotary support 55. The flexible blade 57 is made of one sheet of Mylar, and a distal end 57*a* thereof protrudes to the outside of the end portion 55*b* of the support portion 55B. Since the flexible blades 56 are disposed by dividing Mylar into two sheets, and a distal end 56*a* of the flexible blade 56 protrudes to the outside of the end portion 55*a* of the support portion 55A. In particular, the flexible blades 56 are attached to an attachment surface 55A1 of the support portion 55A such that lateral edges 56*c* protrude to the outside (the fore side and the rear side of the inner wall) from side end portions 55*d* and 55*e* on both sides of the support portion 55A. The flexible blade 57 is made of one sheet of Mylar, and a distal end 57*a* thereof protrudes to the outside of the end portion 55*b* of the support portion 55B. As illustrated in FIGS. 3 to 5, slits 59 are formed at a portion of the flexible blade 57 that protrudes from the end portion 55*b* of the support portion 55B, and slits 59A are formed at a portion of the flexible blades 56 that protrudes from the side end portions 55*d* and 55*e* of the support portion 55A.

The material of the flexible blades 56 and 57 is not limited to the above description, and for example, polyethylene (PE), polypropylene (PP), polyphenylene sulfide (PPS), or a member having flexibility and rigidity such as a polyurethane sheet may be used besides polyethylene-terephthalate (PET) which is a material having a low rigidity and normally called the Mylar. The thickness is preferably about 50 to 500 μm, and more preferably 50 to 300 μm. When the thickness is less than 50 μm, the elasticity is not permanently maintained, and when the thickness exceeds 500 μm, it is not possible to exert the operational effect described below. The distal ends 56*a* and 57*a* serving as at least a part of the flexible blades 56 and 57 protrude to the outside of the end portions 55*a* and 55*b* of the support portions 55A and 55B, and come in slide contact with the container inner wall 51*b* and the arc-shaped surface 51*c*. Therefore, when the rotary shaft 54 of the rotary stirrer 53 is rotatably driven by the driver, the distal ends 56*a* and 57*a* come in slide contact with the container inner wall 51*b* and the arc-shaped surface 51*c*. Accordingly, the flexible blades 56 and 57 transport developer G toward the discharge port 51*a* via the screw 52.

In general, a generation rate of agglomerates of the powder developer G is increased in proportion to a pressure (stress) generated on the sliding surface between the flexible blades 56 and 57 and the container body 51, which may cause an abnormal image. A low temperature fixing of the toner in recent years more prompts the generation of the agglomerates. Therefore, the rigidity of the flexible blades 56 and 57 is necessarily more reduced. Herein, assuming that a definition of the rigidity of the flexible blades 56 and 57 is set to an elastic deformation amount δ with respect to a load F, a member having a small elastic deformation amount δ under the same load F is a member having a large rigidity, and on the contrary, a member having a large elastic deformation amount δ is a member having a small rigidity. Then, as illustrated in FIGS. 5 and 6B, the elastic deformation amount δ when intensive load F is applied to distal ends 56*a* and 57*a* which are free ends of the flexible blades 56 and 57 fixed to the rotary support 55 which is made of a rigid body on one side is given by the following Expression 1.

$$\delta = \frac{FL^3}{6EI} \qquad \text{[Expression 1]}$$

In Expression 1, L represents a free length of the flexible blade, E represents longitudinal elastic modulus of the flexible blade, and a cross section secondary moment of the flexible blade.

As a method of reducing (increasing δ of the above Expression 1) the rigidity of the flexible blades 56 and 57, the following method may be considered from the above Expression 1.

Using a material having a small elastic modulus.

Extending the length of the flexible blade.

Changing the shape (size) of the cross section (perpendicular to an external force) of the flexible blade (Reducing a cross section secondary moment. For example, making the thickness thin, making a cut, etc.). In this way, the rigidity of the flexible blades 56 and 57 is easily reduced.

Among the functions (stirring and transporting the developer G) of the rotary stirrer 53 in the container body 51, the transportation function of the developer G is mostly carried out by the flexible blades 56 and 57. However, as the rigidity of the flexible blades 56 and 57 is reduced, a transportation performance of the developer G is degraded, and the developer is hardly transported. Specifically, as illustrated in the conventional example of FIG. 6A, the flexible blades 56 and 57 serving as a rotary stirrer 53X of a developer container 50X are deformed before the developer G begins to move, so that the transportation function of the developer G is lost by the deformed amount. This phenomenon occurs with a higher probability when the developer has a low liquidity such as the low temperature fixed toner in the recent years or the developer held tight by the vibration during the transportation. This phenomenon is remarkably exhibited in a case where the flexible blades 56 and 57 are attached to attachment surfaces 55A2 and 55B2 of the support portions 55A and 55B of a rotary support 55X serving as the surface on the downstream side in the rotation direction R of the rotary stirrer 53X as illustrated in FIG. 6A. In other words, at the time of the rotation of the rotary stirrer 53X, the flexible blades 56 and 57 are elastically deformed to the upstream side in the rotation direction R due to the resistance against the developer G, and transport the developer G.

However, in a case where the flexible blades 56 and 57 are attached to the attachment surfaces 55A2 and 55B2 of the support portions 55A and 55B, the elastic deformation to the upstream side in the rotation direction R is hindered by edges 55*a* 1 and 55*b*1 of the end portions 55*a* and 55*b*, and the blades may be folded from the edges 55*a*1 and 55*b*1. In addition, when the flexible blades 56 and 57 are folded as described above, the so-weakened rigidity becomes strong again, so that the blades are kept in the plate shape without elastic deformation. Then, the distal ends 56*a* and 57*a* of the flexible blades 56 and 57 come in strong contact with the container inner wall 51*b* and the arc-shaped surface 51*c*, and the developer G is rubbed on the container inner wall 51*b* and the arc-shaped surface 51*c*, so that it causes a residual developer. Therefore, the configuration of the related art has a problem in that the reduction in rigidity of the flexible blades 56 and 57 is incompatible with the transportation function.

Therefore, in the present comparative example, as illustrated in FIG. 4, the flexible blades 56 and 57 are configured to be attached to the attachment surfaces 55A1 and 55B1 of the support portions 55A and 55B positioned on the upstream side in the rotation direction R of the rotary stirrer 53 in order not to abut on the edges 55*a* 1 and 55*b*1 at the time of the rotation of the rotary stirrer 53. In other words, for the flexible blades 56 and 57, the base end portions 56*b* and 57*b* are mounted and supported on the attachment surfaces 55A1 and 55B1 so that the distal ends 56*a* and 57*a* protrude in a centrifugal direction of the rotary shaft 54. With such a configuration, as illustrated in FIG. 6B, the distal ends 56*a* and 57*a* of the flexible blades 56 and 57 (having a length indicated by arrow L) protruding from the end portions 55*a* and 55*b* of the rotary support 55 (the support portions 55A and 55B) do not contact the edges 55*a*1 and 55*b*1 of the end portions 55*a* and 55*b*. Therefore, even when the rotary stirrer 53 rotates and the blades are deformed to the upstream side in the rotation direction R due to the resistance against the developer G, the deformation is not operated as a hindrance, thus preventing the folding. Accordingly, it is possible to suppress that the developer G is rubbed on the container inner wall 51*b* and the arc-shaped surface 51*c* and that the transportation function of the developer G is reduced. In addition, the residual developer can be reduced, and the reduction in rigidity of the flexible blades 56 and 57 can be compatible with the transportation function.

In addition to the above configuration, in this comparative example, as illustrated in FIGS. 4 and 6B, the end portions 55*a* and 55*b* serving as free ends of the support portions 55A and 55B in the rotary support 55 are configured to have the shape dimension to approach the container inner wall 51*b*. With such a configuration, the end portions 55*a* and 55*b* of the support portions 55A and 55B in the rotary support 55 considered as a substantial rigid body do not abut on the container inner wall 51*b*, but is present almost up to the container inner wall 51*b*, so that the rotary support 55 can stir and transport a more amount of the developer G. Finally, an allotted amount of the developer G to be transported at a time by the flexible blades 56 and 57 corresponds only to the amount of the developer G present in a gap between the end portions 55*a* and 55*b* of the support portions 55A and 55B and the blades and the container inner wall 51*b* and the arc-shaped surface 51*c*. Therefore, the developer G can be transported without causing a phenomenon that even the flexible blades 56 and 57 having a low rigidity are completely deformed due to the resistance of the developer G.

Figure 7A:
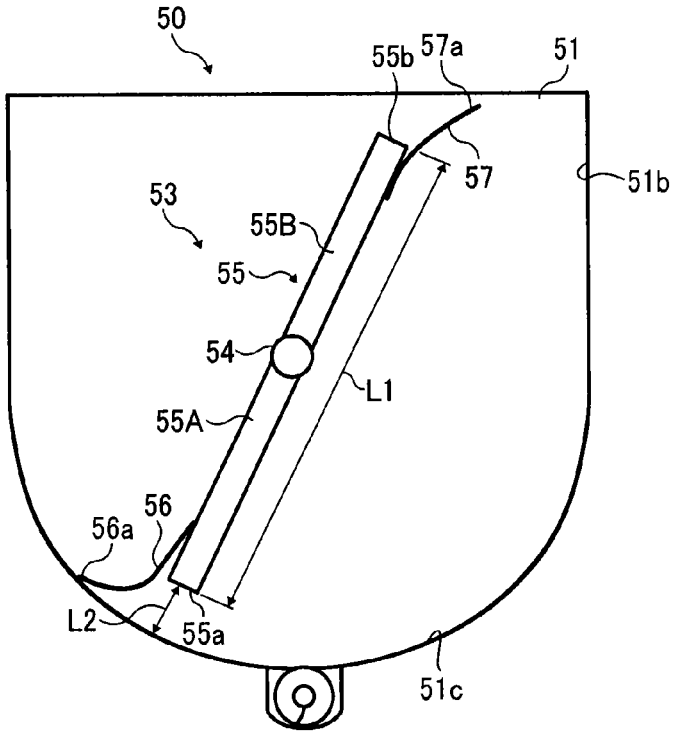
FIGS. 7A and 7B are diagrams for describing a relation between dimensions of parts constituting the rotary stirrer, and a container body in the comparative example.
Figure 7B:
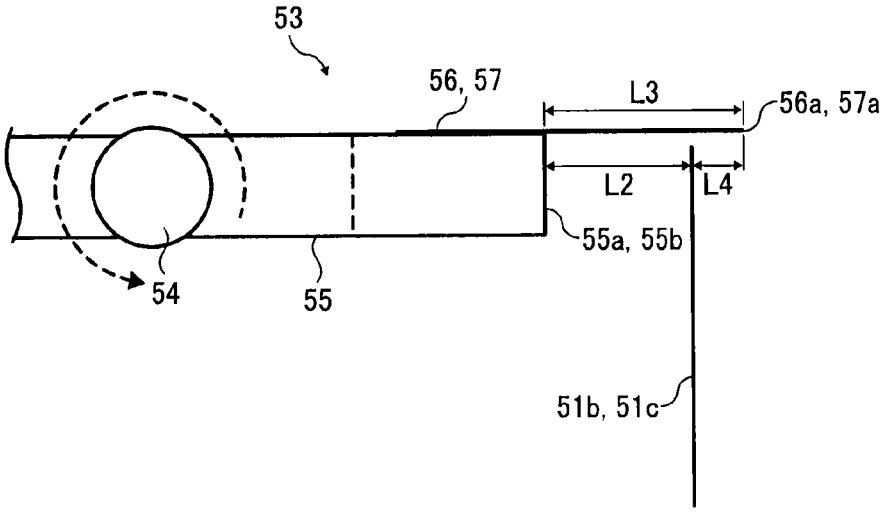

A length relation of the rotary stirrer 53 is described with reference to FIGS. 7A and 7B.

Herein, the description is made using the flexible blades 56 and 57 as the flexible blade. In FIG. 7A, the entire length L1 of the rotary support 55 in a rotation radius direction is desirably set to approach the container inner wall 51*b* and the arc-shaped surface 51*c* as long as it does not abut on the container inner wall 51*b* and the arc-shaped surface 51*c*. Specifically, it is preferable that a distance (gap) L2 between the arc-shaped surface 51*c* (the bottom of the container) and the end portions 55*a* and 55*b* of the rotary support 55 is about 0.5 to 5 mm. In addition, a rotational trajectory shape of the rotary support 55 is preferably formed in accordance with the internal shape of the container body 51 in order to make the distance (gap) L2 small to a degree that the rotary support 55 does not contact container inner walls 51*b* and arc-shaped surface 51*c*. In other words, it can be said that the rotational trajectory shape of each of the end portions 55*a* and 55*b* in the rotary support 55 substantially match with the shapes of the container inner wall 51*b* and the arc-shaped surface 51*c* to such a degree that the end portions 55*a* and 55*b* do not contact the container inner walls 51*b* and the arc-shaped surface 51*c*. With such a dimensional relation, the amount of the developer to be transported by the rotary support 55 is increased and the allotted amount of the developer to be transported by the flexible blades 56 and 57 is reduced, so that the rigidity of the flexible blades 56 and 57 can be more reduced.

The flexible blades 56 and 57 transport the developer G in a state where the distal ends 56*a* and 57*a* contacts at least the container inner wall 51*b* and the arc-shaped surface 51*c* of the container body 51. Therefore, as illustrated in FIG. 7B, an amount (a protruding length, a free length) L3 protruding from the end portions 55*a* and 55*b* of the rotary support 55 is at least 5 mm or more, and the container inner wall 51*b*, and the blades abut on the arc-shaped surface 51*c* or dig the arc-shaped surface about 0 to 20 mm. When the digging amount exceeds 20 mm, a range of the flexible blades 56 and 57 abutting on the container inner wall 51*b* and the arc-shaped surface 51*c* becomes wider and a contact resistance becomes larger. The protruding amount (the protruding length, the free length) L3 is an amount protruding in the direction (the centrifugal direction of the rotary shaft 54) perpendicular to the rotation center O of the rotary shaft 54. The digging amount of the flexible blades 56 and 57 to the container body 51 is affected by a developer transportation force (a remaining amount of the developer when the developer container is exchanged), Accordingly, the digging amount is preferably set in a range of about 0 to 20 mm in consideration of the type of the developer, a material of the flexible blades 56 and 57, or the distance (gap) L2 between the arc-shaped surface 51*c* (the bottom of the container) and the end portions 55*a* and 55*b* of the rotary support 55. Further, the digging amount herein is a length L4 from a contact portion between the flexible blades 56 and 57 attached to the rotary support 55 and the container inner wall 51*b* (or the arc-shaped surface 51*c*) to the distal end when the rotary stirrer 53 is stopped as illustrated in FIG. 7B. Therefore, a digging amount of 0 mm indicates a state where the distal end of each flexible blade abuts on the container inner wall 51*b* or the arc-shaped surface 51*c*. The thickness of the flexible blades 56 and 57 is preferably about 200 μm to 2 mm in a case where the blades are made of a polyurethane film. In this case, the protruding amount L3 is preferably 5 mm or more. In a case where the blades are made of a polyurethane film and the thickness is 1 mm or more, the protruding amount L3 is preferably 10 mm or more. As the developer G used in the present comparative example, a toner as the developer supporting the low temperature fixing at an outflow temperature of 90° C. (that is, the developer (toner) having a relatively bad liquidity) is used.

In the flexible blades 56 and 57, the slit 59 is formed, so that the rigidity can be reduced. Therefore, it is expected that a performance of the flexible blades 56 and 57 to transport the developer G be reduced. However, in a case where the stress on the developer G is reduced and the container has a complicated shape, it is preferable that a tracking property with respect to the container body 51 is increased. A need for forming the slit 59 is preferably determined by a relation between the developer transportation force of the flexible blades 56 and 57 and the internal shape of the container body 51.

In the configuration of the related art, as described with reference to FIG. 6A, the flexible blades 56 and 57 are deformed before the developer begins to move, and it is not possible to transport the developer G by the deformed amount or more. However, with the use of the rotary stirrer 53 illustrated in FIGS. 3 to 5 as the comparative example, the rotary support 55 is present almost up to the container inner wall 51*b* or the arc-shaped surface (the bottom surface) 51*c* of the container body 51, so that the rotary support 55 can stir and transport a more amount of toner. In addition, finally, an allotted amount of the developer to be transported at a time by the flexible blades 56 and 57 corresponds only to the amount of the developer present in the gap L2 between the container inner wall 51*b* or the arc-shaped surface (the bottom surface) 51*c* and the end portions 55*a* and 55*b* of the rotary support 55. Therefore, even when the flexible blades 56 and 57 have a low rigidity, there occurs no complete deformation caused by the developer G, so that the developer can be transported. Accordingly, it is possible to reduce the amount of the residual developer even while securing the transportation performance of the developer.

Figure 8:
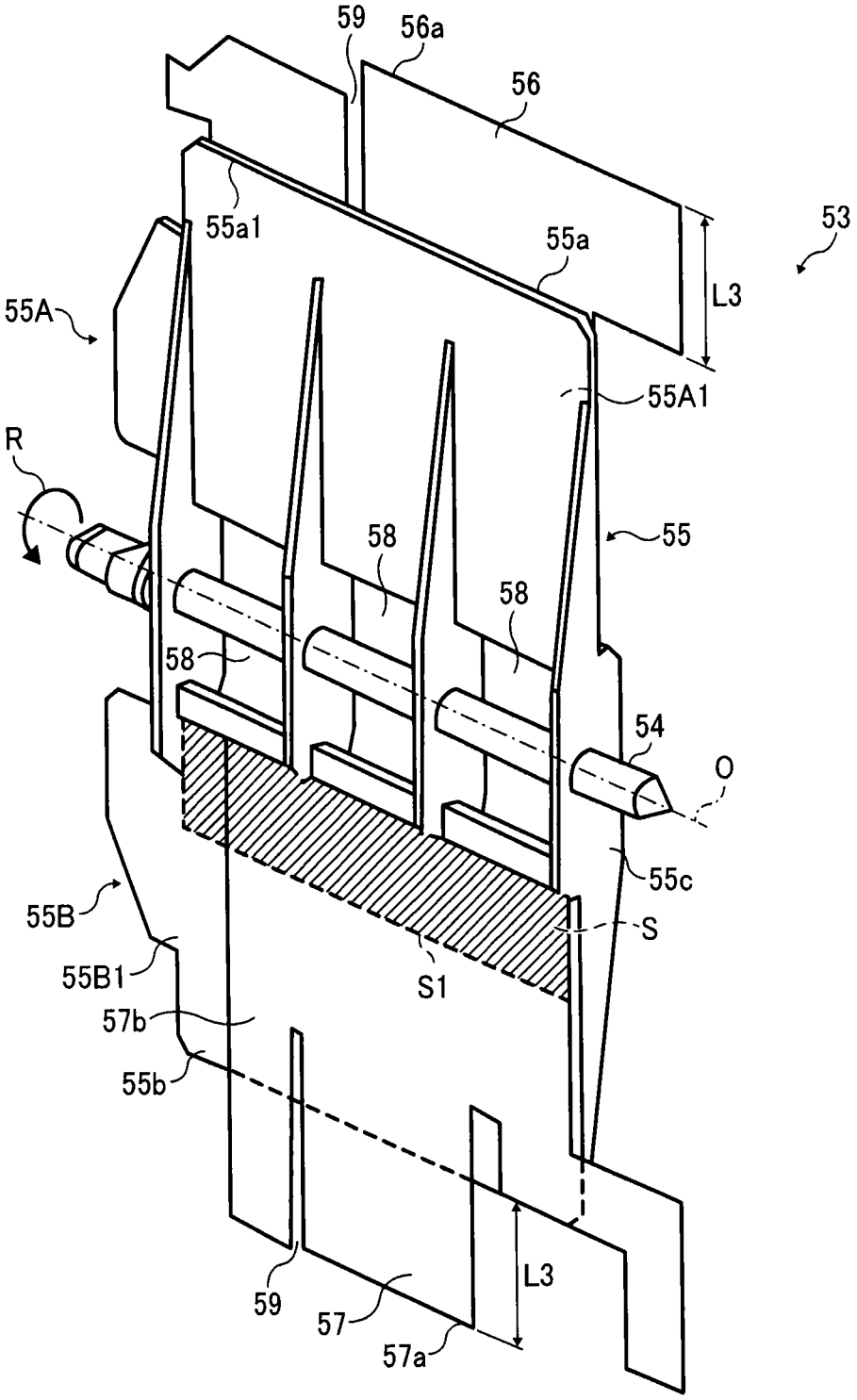
FIG. 8 is an enlarged perspective view of a rotary stirrer according to a comparative example different from FIG. 3.

The flexible blade and the rotary support may be formed in any shape according to the shape of the container, and the invention is not limited to the shape illustrated in FIGS. 3 to 5. In addition, the number of flexible blades may be two or more, and each blade may be formed in a different shape. As a comparative example different from the comparative example illustrated in FIGS. 3 to 5, the rotary stirrer 53 as illustrated in FIG. 8 may be employed. In the present comparative example, the opening 58 is formed in the rotary support 55, and the developer G passes through the opening 58 at the time of the rotation of the rotary stirrer 53, so that a rotational resistance applied on the rotary support 55 is reduced as much as possible. Therefore, since the rotational resistance of the rotary support 55 is increased when the opening 58 is closed, the flexible blades 56 and 57 are attached in a region on the outside of the opening 58 in the attachment surfaces 55A1 and 55B1 in order to avoid the opening 58.

The flexible blades 56 and 57 are attached and fixed by bonding the base end portions 56*b* and 57*b* to the attachment surfaces 55A1 and 55B1 of the support portions 55A and 55B (the rotary support 55) using an adhesive or a double-sided tape. Therefore, when the bonding region is extended up to the end portions 55*a* and 55*b* of the support portions 55A and 55B (the rotary support 55), only the distal ends 56*a* and 57*a* protruding to the outside of the end portions 55*a* and 55*b* are elastically deformed to the upstream side in the rotation direction R, so that the elastic deformation amount may be restricted. For this reason, in this embodiment, as illustrated in FIG. 8, an end portion S1 of a bonding region S of the flexible blades 56 and 57 is offset toward the rotary shaft 54 from the end portions 55*a* and 55*b* of the support portions 55A and 55B. The bonding region S (area) may be made small as long as the flexible blades 56 and 57 and the support portions 55A and 55B (the rotary support 55) are securely bonded. The same also goes to the flexible blades 56 and 57 and the support portions 55A and 55B (the rotary support 55) illustrated in FIG. 5.

When the bonding region S is set as described above, the distal ends 56*a* and 57*a* protruding to the outside of the end portions 55*a* and 55*b* are elastically deformed to the upstream side in the rotation direction R, and also elastically deformed from a portion on the outside of the end portion S1 of the bonding region S. In other words, since the deformed regions of the flexible blades 56 and 57 are overlapped with the support portions 55A and 55B (the rotary support 55), sufficient stiffness can be obtained without restricting the elastic deformation amount, and the transportation performance can be secured.

As illustrated in FIG. 6A, in the conventional example, the flexible blades 56 and 57 serving as the rotary stirrer 53X are deformed before the developer G begins to move, so that it is not possible to stir and transport the developer G by the deformed amount or more. Furthermore, a decrease in the fixing temperature of the developer is advanced from the point of view of saving energy in the recent years, and the agglomerates are more apparently generated in the developer (toner) supporting the low temperature fixing due to slide stress. Therefore, the rigidity of the flexible blades 56 and 57 is necessarily more reduced. However, on the other hand, when the developer is fixed at a low temperature, the liquidity is reduced, and the developer is not possible to be efficiently transported by the flexible blades 56 and 57 reduced in the rigidity. When the rotary stirrer 53 of the comparative example illustrated in FIGS. 3 to 5 and FIGS. 7A, 7B, and 8 is used, the rotary support 55 is present close to the container inner wall 51*b*, so that the rotary stirrer 53 can stir and transport a more amount of the developer G. Finally, an allotted amount of the developer G to be transported at a time by the flexible blades 56 and 57 corresponds only to the amount of the developer G present in a gap between the blades and the container inner wall 51*b* or the arc-shaped surface 51*c* of the bottom. Therefore, the developer G can be transported without causing a phenomenon that even the flexible blades 56 and 57 having a low rigidity are completely deformed due to the resistance of the developer G.

However, in the rotary stirrer 53 as illustrated in FIGS. 3 to 5 and FIGS. 7A, 7B, and 8, since a projected area in the rotation direction R of the rotary support 55 is large as can be seen in FIGS. 3 to 5 and FIGS. 7A, 7B, and 8, a load of the developer G on the rotary support 55 becomes larger when the developer G apparently increased in volume density is stirred. As a result, a side effect is caused that a rotation torque of the rotary stirrer 53 is apparently increased. In this case, if a portion of the rotary support 55 further away from the rotary shaft 54 in the centrifugal direction has a larger projected area, the load of the developer G to the rotary support 55 is greater on the principle of moment of force, thus significantly increasing the rotation torque of the rotary stirrer 53. Then, the developer container including, e.g., the inventors of the present disclosure create the rotary stirrer according to embodiments of the present disclosure described herein.

[First Embodiment]

A developer container according to a first embodiment of the present disclosure includes: a container body containing a developer and having a discharge port through which to discharge the developer contained in the container body, a rotary stirrer which is disposed in the container body and rotates about a rotary shaft to transport the developer contained in the container body while stirring the developer; a lattice rotary support which is provided in the rotary stirrer, includes a base end integrally rotating with the rotary shaft and a free end disposed closely to an inner wall of the container body, and has plural openings across a longitudinal direction of the rotary shaft; and a flexible blade which is parallel to a rotation direction of the rotary support or inclined with respect to the rotation direction, includes a base end portion which is held in the free end or in a holding surface formed in a portion on a side near the rotary shaft separated from the free end and a distal end which abuts on at least the inner wall of the container body, and transports the developer to the discharge port. Hereinafter, the details of the configuration are specifically described.

Figure 9:
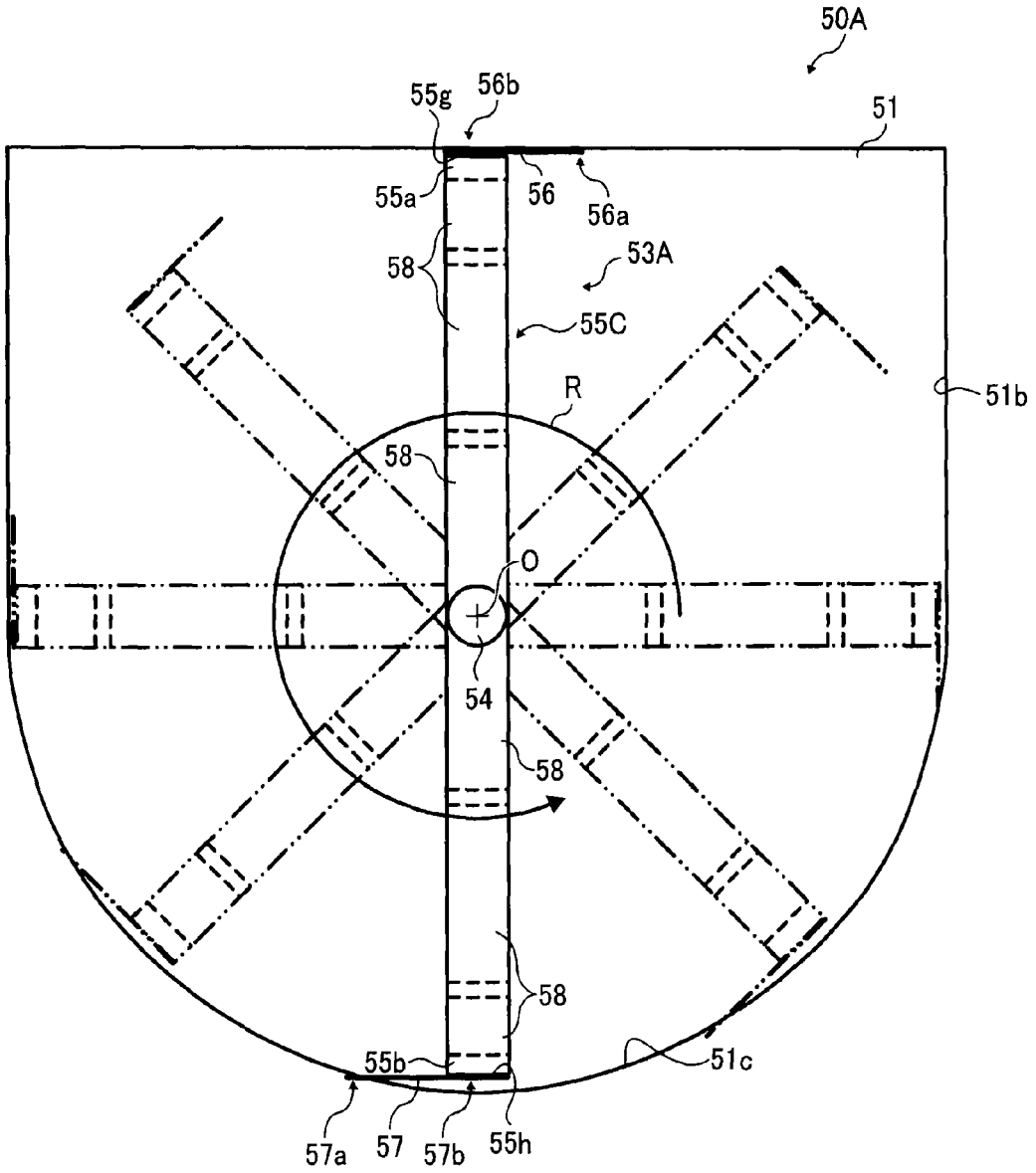
FIG. 9 is a schematic front view illustrating a configuration of a developer container according to a first embodiment.
Figure 10:
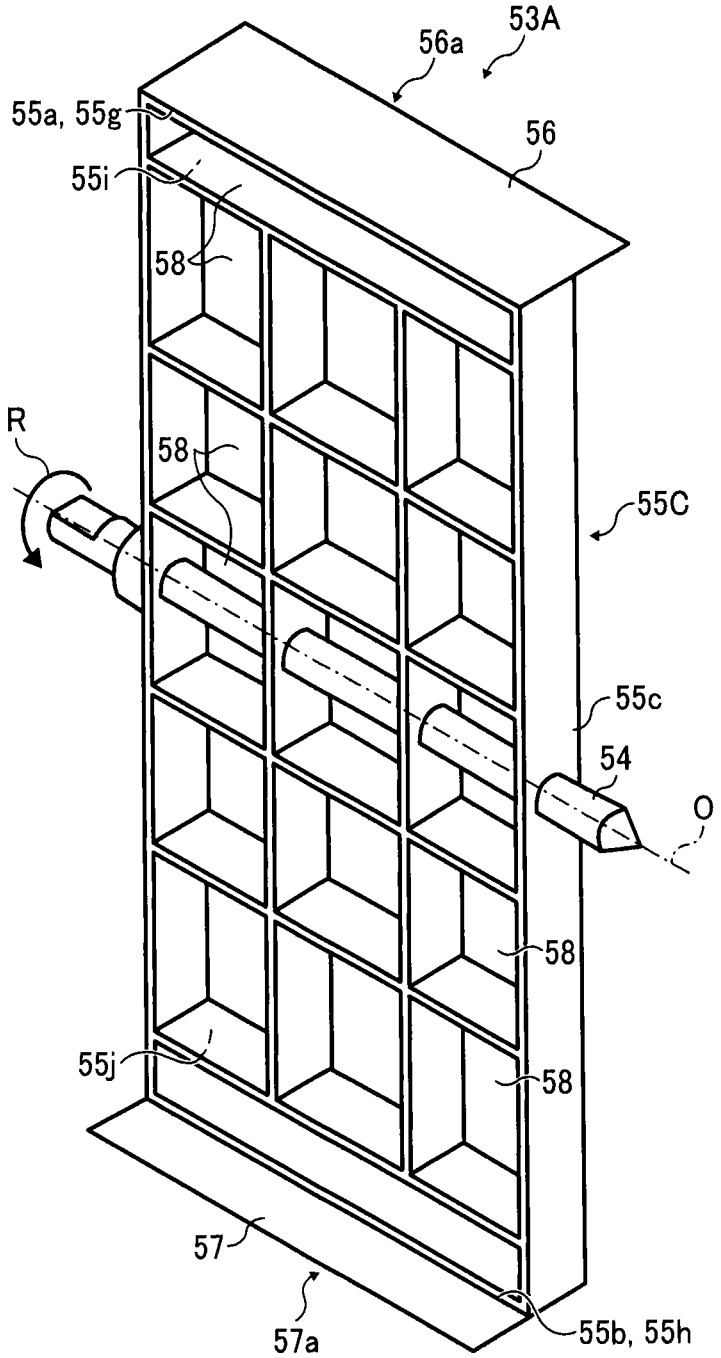
FIG. 10 is an outer perspective view of a rotary stirrer built in the developer container of FIG. 9.

FIGS. 9 and 10 illustrate a developer container according to a first embodiment. FIG. 9 is a schematic front view illustrating a configuration of the developer container according to the first embodiment. FIG. 10 is an outer perspective view of a rotary stirrer built in the developer container of FIG. 9. In FIG. 9, a detailed configuration of the screw and the like are not illustrated for the sake of simplicity in the drawing (this is the same even in a developer container according to the following variations of FIG. 11 and the subsequent drawings, except for a variation 4 illustrated in FIGS. 16 to 20). In FIG. 9, some rotational trajectories of a rotary stirrer 53A depicted with a solid line are illustrated with a two-dotted chain line (this is the same even in the rotary stirrer according to the variations of FIG. 11 and the subsequent drawings). In addition, in FIG. 9, the distal ends 56*a* and 57*a* of the flexible blades 56 and 57 abut on the container inner wall 51*b* and the distal end portions are elastically deformed and bent. However, the flexible blades 56 and 57 are illustrated to protrude to the outside from the container inner wall 51*b* in order to apparently divide the free length and the overlapped area. This is the same even in the plan views according to the variations of FIG. 11 and the subsequent drawings. A developer container 50A of the first embodiment is mainly different from the developer container 50 of the comparative example illustrated in FIGS. 3 to 5 in that the rotary stirrer 53A is used instead of the rotary stirrer 53. The configurations of the developer container 50A other than the difference are identical or similar to those of the developer container 50 according to the comparative example. Hereinafter, a detailed description is made about the rotary stirrer 53A focusing on the different point.

The rotary stirrer 53A is mainly different from the rotary stirrer 53 of the comparative example in that a rotary support 55C is used instead of the rotary support 55 and in a method of holding and attaching the flexible blades 56 and 57 to the rotary support 55C (an attaching position and an attaching direction). The rotary stirrer 53A includes the rotary support 55C integrally rotating with the rotary shaft 54, and the flexible blades 56 and 57 supported and fixed on both end portions of the rotary support 55C in a specific manner described below. The rotary shaft 54 and the rotary support 55C may be integrally formed with an appropriate resin for the sake of reduction in weight and cost down similarly to the comparative example, or may be integrally configured with metal or resin. The rotary shaft 54 is disposed such that the rotation center O is concentric to the arc center of the arc-shaped surface 51*c* similarly to the comparative example. As described above, the rotary shaft 54 and the rotary support 55C can be regarded as substantially a rigid body having a fully rigidity. Accordingly, the rotary support 55C is so-called a bone-shaped member and capable of stirring and loosening the developer. The rotary support 55C is formed in a shape having no surface perpendicular to the rotation direction R other than a lattice framework compared to the rotary support 55 of the comparative example. The rotary support 55C has multiple openings 58, through which the developer is passively, across a longitudinal direction of the rotary shaft 54. For example, the rotary support 55C illustrated in FIG. 10 has a total of twenty openings 58 at both sides of the rotary shaft 54: ten are at one side thereof and ten are at the other side. The rotary support 55C has a total area of the openings 58 greater than that of the openings of the rotary support 55 of the comparative example. The rotary support 55C is formed to be symmetrical with respect to the center line (the symmetric axis) of the rotation center O of the rotary shaft 54 in the front view of FIG. 9.

In the free end included in the end portions 55*a* and 55*b* of the rotary support 55C, holding surfaces 55*g* and 55*h* are formed to be parallel to the rotation direction R of the rotary support 55C. The holding surfaces 55*g* and 55*h* also serve as attachment surfaces to which the flexible blades 56 and 57 are attached. The rotary support 55C is configured such that the holding surfaces 55*g* and 55*h* of the end portions 55*a* and 55*b* are disposed to approach the container inner wall 51*b* similarly to the comparative example (see FIG. 7A). In this way, the rotary support 55C may be configured such that a maximum length in the rotation radius direction is extended up to the container inner wall 51*b* and the arc-shaped surface 51*c* (the bottom of the container) as long as the rotary support does not abut on the container inner wall 51*b* and the arc-shaped surface 51*c* (the bottom of the container). Specifically, the distance (gap) between the holding surfaces 55*g* and 55*h* serving as the free end of the rotary support 55C and the arc-shaped surface 51*c* (the bottom of the container) is preferably set to 0.5 to 5 mm. In addition, a rotational trajectory shape of the holding surfaces 55*g* and 55*h* of the rotary support 55C is formed to be substantially matched with the internal shape of the container body 51 to make the distance (gap) small.

The flexible blades 56 and 57 are held and fixed such that the base end portions 56*b* and 57*b* are attached to the holding surfaces 55*g* and 55*h* of the rotary support 55C by an adhesive or a double-sided tape. The distal ends 56*a* and 57*a* of the flexible blades 56 and 57 abut at least on the container inner wall 51*b* by the shape and the attachment of the above-mentioned rotary support 55C, and abut on the container inner wall 51*b* and the arc-shaped surface 51*c* (the bottom of the container) to transport the developer. In addition, the shapes of the distal end portions of the flexible blades 56 and 57 can be freely employed while being matched with the internal shape of the container body 51 in consideration of the rotational trajectory shape. In other words, it can be said that the rotational trajectory shape of the flexible blades 56 and 57 are substantially matched with the shapes of the container inner wall 51*b* and the arc-shaped surface 51*c* (the bottom of the container).

The flexible blades 56 and 57 having the same free length are attached to the holding surfaces 55*g* and 55*h*, but the free length may be different as long as it satisfies a condition that the distal ends 56*a* and 57*a* abut at least on the container inner wall 51*b* and the arc-shaped surface 51*c* (the bottom of the container). In addition, the shape of the flexible blade itself may be differently made. In the embodiment of FIGS. 9 and 10, in a state where the flexible blades 56 and 57 are attached to the holding surfaces 55*g* and 55*h* of the rotary support 55C, the flexible blades are formed so as to be symmetrical about the rotation center line of the rotation center O of the rotary shaft 54 as illustrated in FIG. 9.

According to the present first embodiment, the following operational effects are obtained by the configuration of the above-mentioned rotary stirrer 53A. In other words, the holding surfaces 55*g* and 55*h* to which the flexible blades 56 and 57 are held and attached are not perpendicular to the rotation direction R, but parallel to the rotation direction R. With this configuration, it is possible to suppress an increase in a projected area in the rotation direction R of the rotary support 55C which is caused by the attachment surfaces of the flexible blades 56 and 57 (the holding surfaces), and thus the resistance of the developer upon stirring can be reduced. In addition, the rotary support 55C of the rotary stirrer 53A has no surface perpendicular to the rotation direction R except the lattice framework. Therefore, the torque upon stirring can be significantly reduced compared to the rotary stirrer 53 of the comparative example. In addition, since the rotary support 55C is manufactured in a substantial framework and a large number of openings 58 are formed, the stirring performance of the developer seems to be degraded compared to the conventional example and the comparative example, but the intension is as follows. First, the rotary support 55C substantially structured as the framework passes through the developer before the flexible blades 56 and 57 transports the developer, and thus the developer is loosened. Such a configuration facilitates transportation of the developer, and the flexible blades 56 and 57 passing thereafter can transport the developer G to the screw 52 against the resistance of the developer G. Such a configuration can reduce the rigidity of the flexible blade, improve the performance of the rotary stirrer of stirring and transporting a developer having a bad fluidity, and avoid an increase of the rotation torque of the rotary stirrer at the same time.

By contrast, a conventional art may not solve problems such as a reduction in stirring/transport performance of low temperature fixed toner with a decreased rigidity of the flexible blade or the developer (toner) in a highly tight and dense state, and an increase of the rotation torque of the rotary stirrer.

[First Variation]

Figure 11:
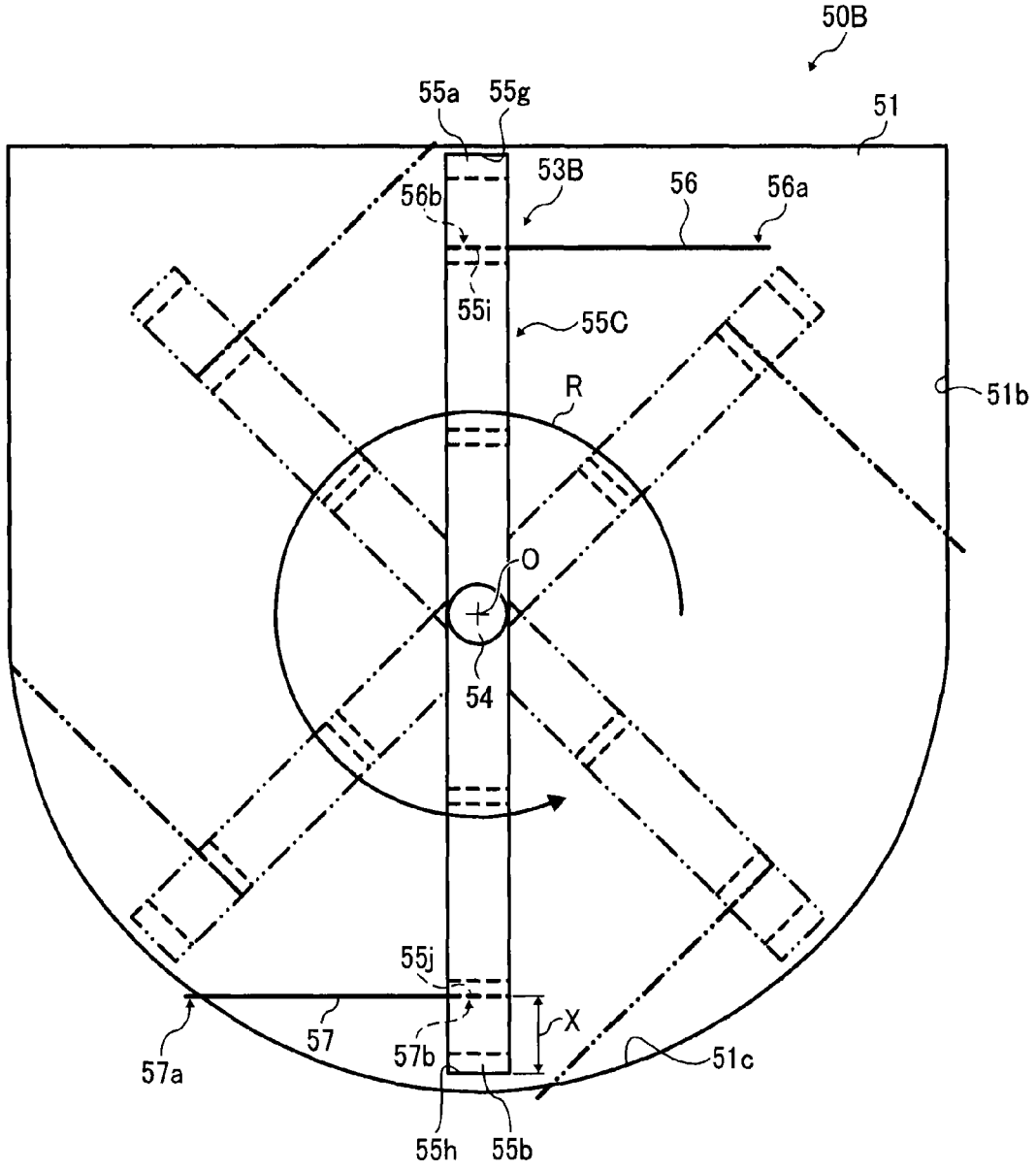
FIG. 11 is a schematic front view illustrating a configuration of a developer container according to a first variation.
Figure 12:
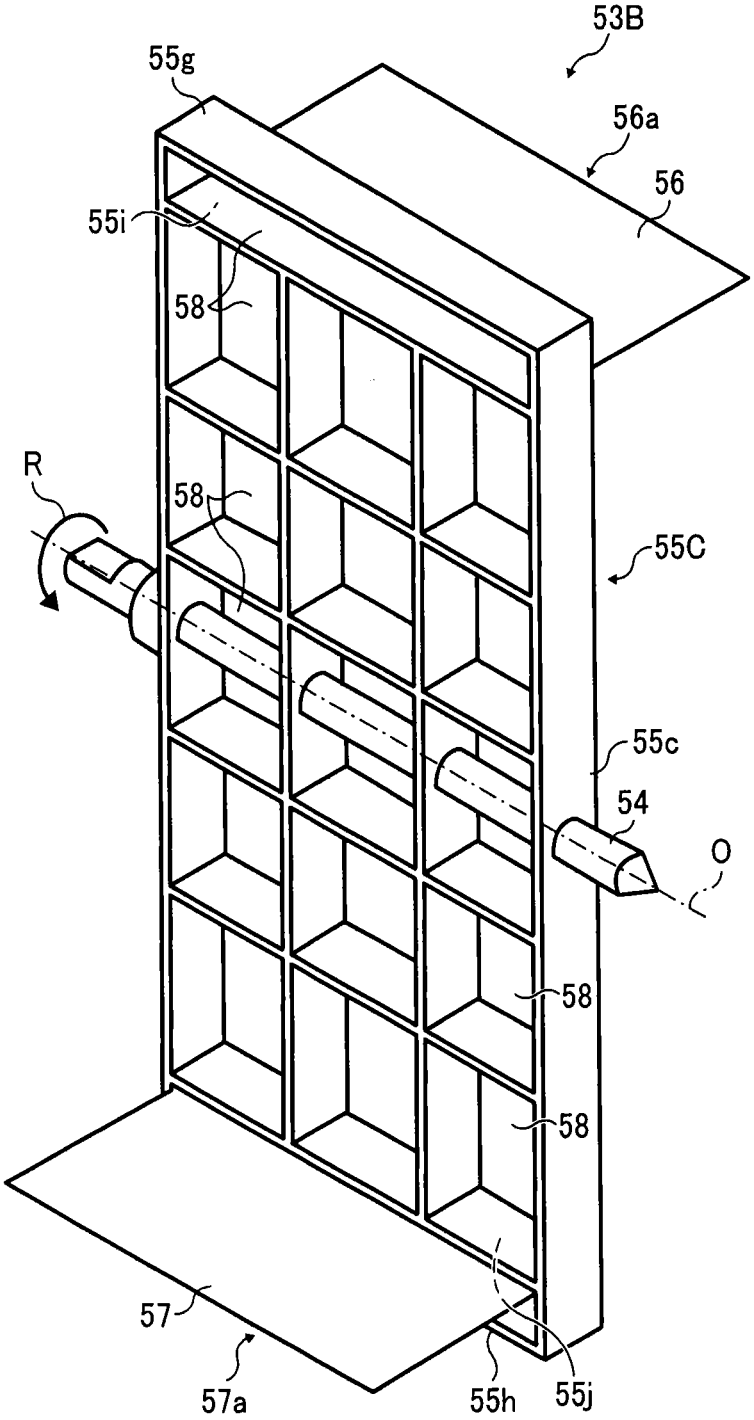
FIG. 12 is an outer perspective view of a rotary stirrer built in the developer container of FIG. 11.

A developer container according to a first variation of the first embodiment is described using FIGS. 11 and 12.

FIG. 11 is a schematic front view illustrating a configuration of the developer container according to the first variation, and FIG. 12 is an outer perspective view of a rotary stirrer built in the developer container of FIG. 11. A developer container 50B of the first variation is different from the developer container 50A of the first embodiment illustrated in FIGS. 9 and 10 in that the developer container 50B employs a rotary stirrer 53B instead of the rotary stirrer 53A. The configurations of the developer container 50B other than the difference are identical or similar to those of the developer container 50A according to the first embodiment. Below, the rotary stirrer 53B is further described focusing on the difference.

The rotary stirrer 53B is mainly different from the rotary stirrer 53A of the first embodiment in a method of holding and attaching the flexible blades 56 and 57 to the rotary support 55C (an attaching position and an attaching direction). The rotary stirrer 53B includes the rotary support 55C integrally rotating with the rotary shaft 54, and the flexible blades 56 and 57 supported and fixed on both end portions of the rotary support 55C in a specific manner described below.

While not described for the first embodiment, the rotary support 55C is formed with holding surfaces 55*i* and 55*j* which are parallel to the rotation direction R of the rotary support 55C in addition to the holding surfaces 55*g* and 55*h* formed at the free ends of the end portions 55*a* and 55*b*. In other words, the rotary support 55C includes the holding surfaces 55*g* and 55*h* formed at the free ends of the end portions 55*a* and 55*b* and the holding surfaces 55*i* and 55*j* formed in a portion on a side near the rotary shaft 54 separated from the holding surfaces 55*g* and 55*h*. In this way, the rotary support 55C includes the holding surfaces 55*g* and 55*h* and the holding surfaces 55*i* and 55*j* in a plurality of places, and a distance X (dimension) from the holding surface 55*h* to the holding surface 55*j* (or from the holding surface 55*g* to the holding surface 55*i*) can be arbitrarily set. In other words, the rotary support 55C is configured to be provided with a larger number of holding surfaces serving as the attachment surfaces of the flexible blades 56 and 57. In addition, the flexible blade having a large free length can also be attached by increasing the distance X. In a case where the flexible blade is restricted in a minimum thickness, there is only method of making the free length increase in order to reduce an attaching force of the flexible blade. In this case, an arbitrarily-determined distance X exerts an excellent effect.

According to this first variation, with the configuration of the above-mentioned rotary stirrer 53B, the effects of the above description are also obtained in addition to the operational effect similar to the first embodiment.

[Second Variation]

Figure 13:
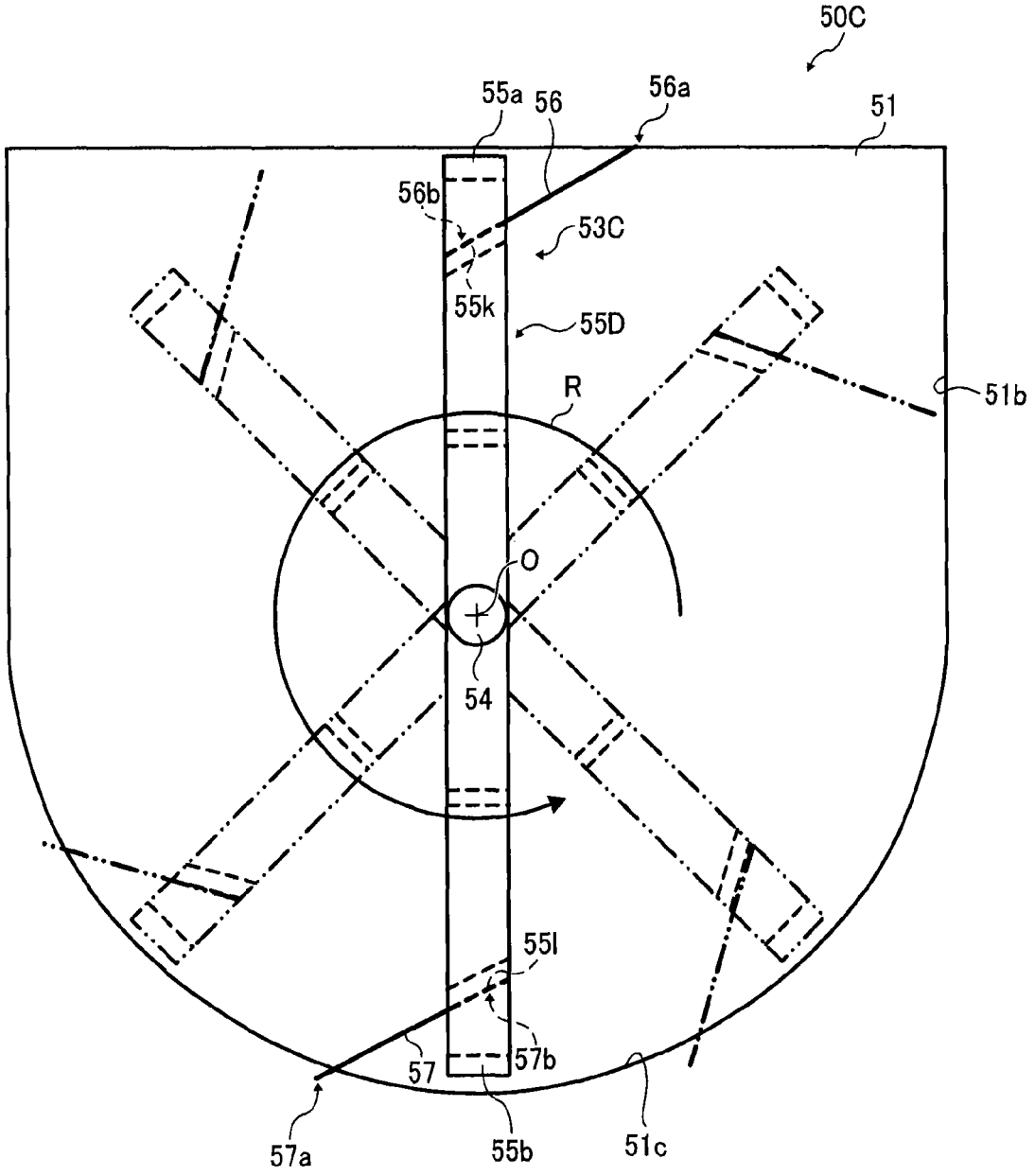
FIG. 13 is a schematic front view of a configuration of a developer container according to a second variation.
Figure 14:
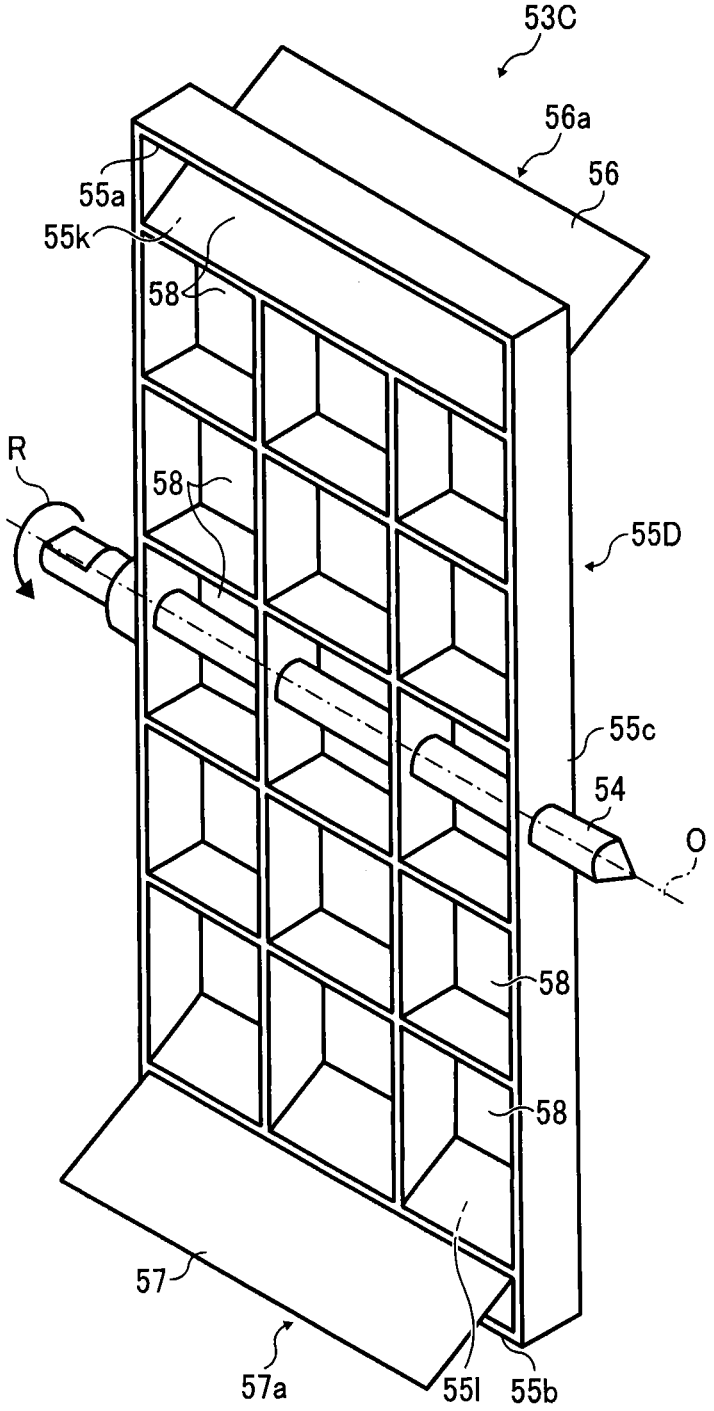
FIG. 14 is an outer perspective view of a rotary stirrer built in the developer container of FIG. 13.

FIGS. 13 and 14 illustrate a developer container according to a second variation of the first embodiment. FIG. 13 is a schematic front view illustrating a configuration of the developer container according to the second variation. FIG. 14 is an outer perspective view of a rotary stirrer built in the developer container of FIG. 13.

A developer container 50C of the second variation is different from the developer container 50B of the first variation illustrated in FIGS. 11 and 12 in that the developer container 50C employs a rotary stirrer 53C instead of the rotary stirrer 53B. The configurations of the developer container 50C other than the difference are identical or similar to those of the developer container 50B according to the first variation. Hereinafter, a detailed description is made about the rotary stirrer 53C focusing on the different point.

The rotary stirrer 53C is mainly different from the rotary stirrer 53B of the first variation in that a the rotary support 55D is used instead of the rotary support 55C and in a method of holding and attaching the flexible blades 56 and 57 to the rotary support 55D (an attaching position and an attaching direction). The rotary stirrer 53C includes the rotary support 55D integrally rotating with the rotary shaft 54, and the flexible blades 56 and 57 supported and fixed on both end portions of the rotary support 55D in a specific manner described below. The rotary support 55D is different from the rotary support 55C in that holding surfaces 55*k* and 55*l* inclined with respect to the rotation direction R of the rotary support 55D to some degree are formed with respect to the holding surfaces 55*i* and 55*j* of the rotary support 55C. The holding surfaces 55*k* and 55*l* are formed with an inclination of 0 to 90 degrees with respect to the rotation direction R of the rotary support 55D. Then, the flexible blades 56 and 57 are attached to the inclined holding surfaces 55*k* and 55*l*.

In the second variation, with the flexible blades 56 and 57 attached to the inclined holding surfaces 55*k* and 55*l*, the transportation performance of the developer of the flexible blades 56 and 57 is improved, but the projected area in the rotation direction R is increased compared to the rotary support 55C of the first variation. Therefore, there is a trade-off with respect to the rotation torque loaded on the rotary stirrer 53C. This trade-off may be adjusted according to a required performance. According to the second variation, except for the above-described technical content, operational effects equivalent to those of the first variation can be obtained.

[Third Variation]

Figure 15:
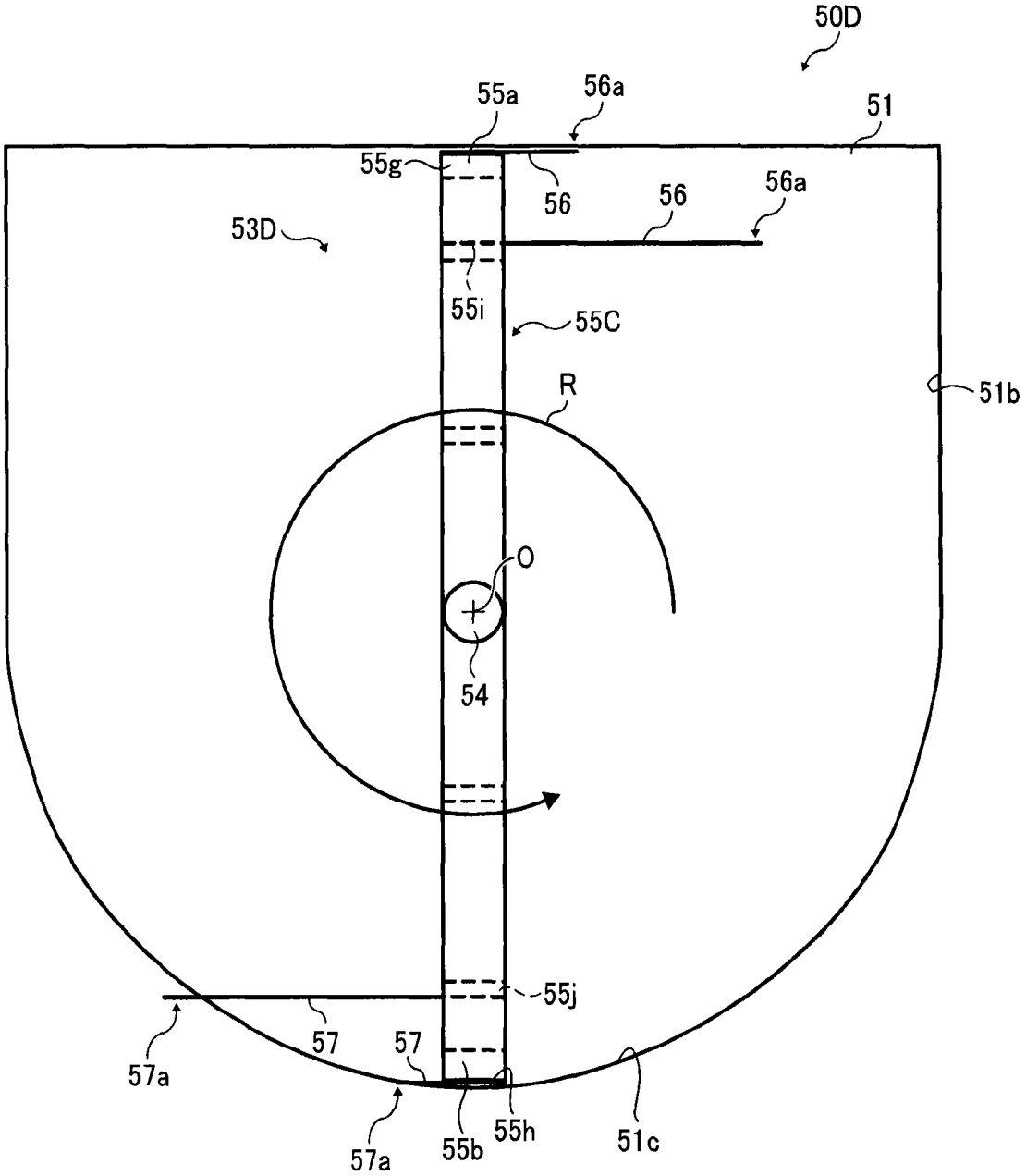
FIG. 15 is a schematic front view of a developer container according to a third variation.

FIG. 15 illustrates a developer container according to a variation (third variation) of the first variation. FIG. 15 is a schematic front view illustrating a configuration of the developer container according to the third variation. A developer container 50D of the third variation is different from the developer container 50B of the first variation illustrated in FIGS. 11 and 12 in that the developer container 50D employs a rotary stirrer 53D instead of the rotary stirrer 53B. The configurations of the developer container 50D other than the difference are identical or similar to those of the developer container 50B according to the first variation. Hereinafter, the description is made about the rotary stirrer 53D focusing on the different point.

The third variation corresponds to a combination of the first embodiment and the first variation. In the example of FIG. 15, as the flexible blades 56 and 57, a total of four blades are attached to each holding surface. Three sheets of flexible blades 56 and 57 in total (on both holding surfaces at the distance X from the holding surface 55*h* to the holding surface 55*j* and from the holding surface 55*g* to the holding surface 55*i*) may be configured to be attached by combining FIG. 9 and FIG. 11 based on the unique configuration of the rotary support 55C. Such a configuration can further improve the transportation performance of developer using three or more sheets of the flexible blades 56 and 57 having different lengths and shapes.

[Fourth Variation]

Next, a developer container 50E according to a fourth variation is described with reference to FIGS. 16 to 20.

Figure 16:
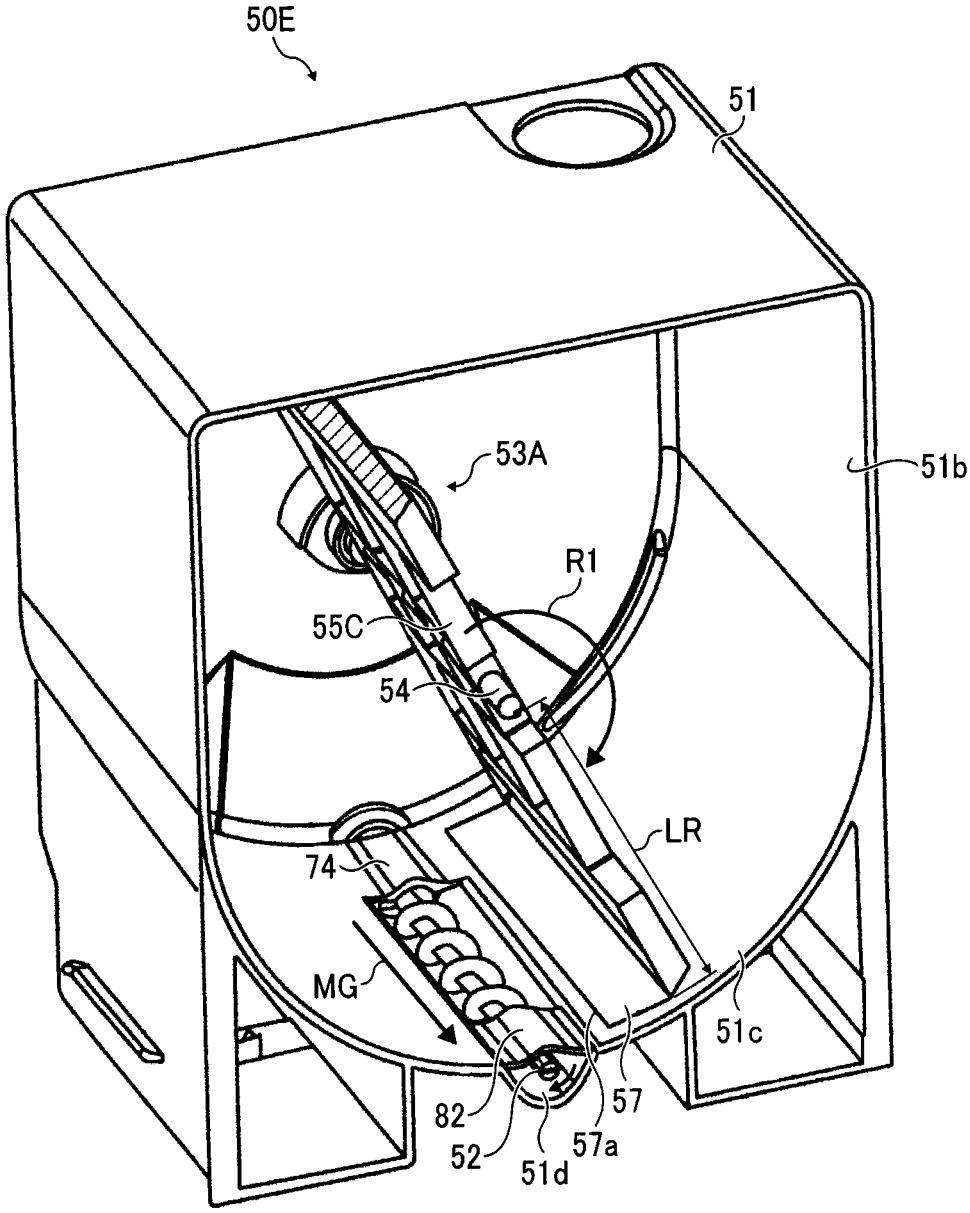
FIG. 16 is a perspective view of a developer container according to a fourth variation.
Figure 17:
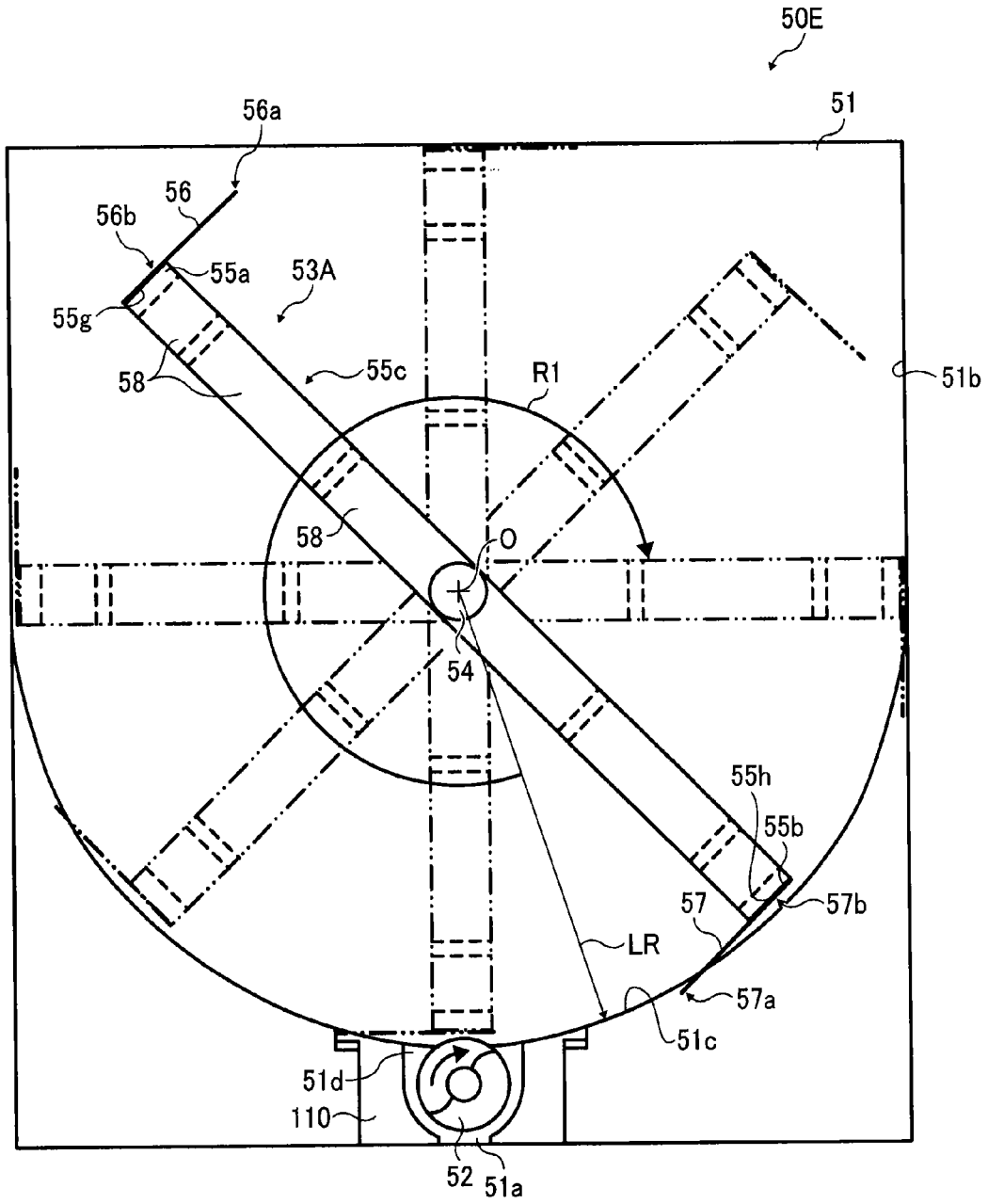
FIG. 17 is a schematic front view of the developer container according to the fourth variation.
Figure 18:
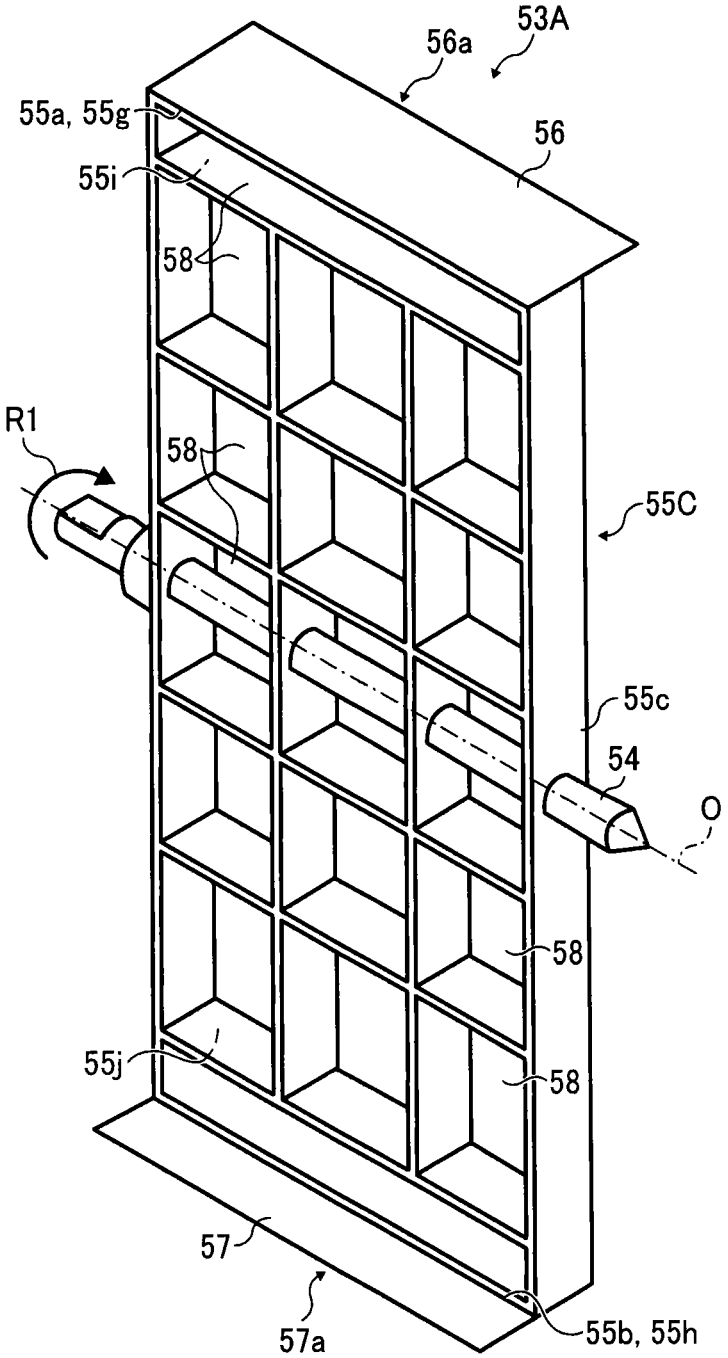
FIG. 18 is an outer perspective view of a rotary stirrer built in the developer container of FIG. 17.
Figure 19:
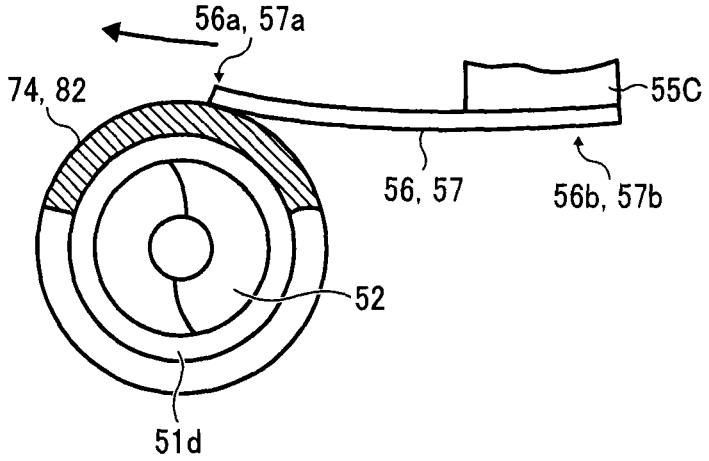
FIG. 19 is a cross sectional view of flexible blades of the rotary stirrer and covers of both axial end portions of a screw in a contact state in the fourth variation.
Figure 20:
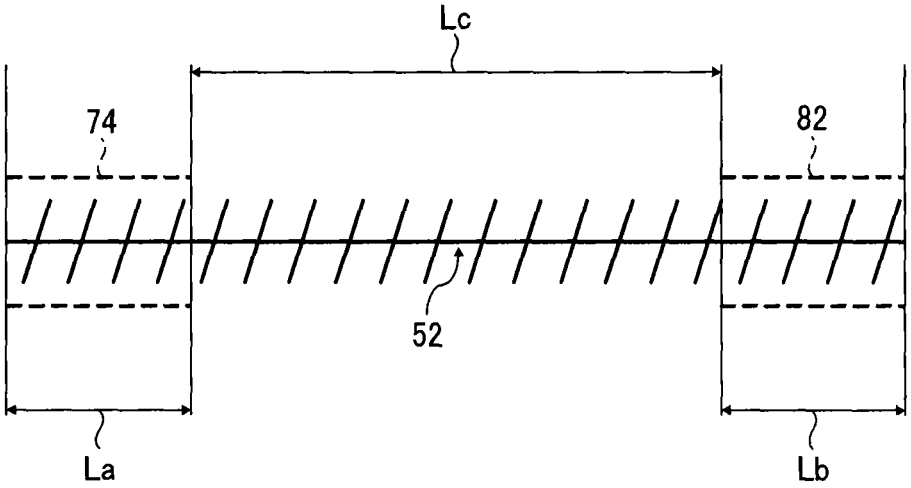
FIG. 20 is a schematic view of covered portions of the screw covered with the covers and exposed portions thereof in the fourth variation.

FIG. 16 is a perspective view illustrating a configuration of a developer container according to the fourth variation. In FIG. 16, for clarity, an upper end portion of a rotary stirrer 53A is cut and an upper end portion of a rotary support and flexible blades are omitted. FIG. 17 is a schematic front view illustrating a configuration of the developer container 50E according to the fourth variation. FIG. 18 is an outer perspective view of the rotary stirrer 53A built in the developer container 50E of FIG. 17. FIG. 19 is a cross sectional view of flexible blades of the rotary stirrer 53A and covers of both axial end portions of a screw 52 in a contact state in the fourth variation. FIG. 20 is a schematic view of covered portions of the screw covered with the covers and exposed portions thereof.

The developer container 50E of the fourth variation is different from the developer container 50A of the first embodiment illustrated in FIGS. 9 and 10 mainly in that the rotary shaft 54 and the rotary stirrer 53A in the fourth variation rotate in a rotation direction R1 opposite the rotation direction R of the rotary shaft 54 and the rotary stirrer 53A of the developer container 50A and that the developer container 50E includes a rear screw cover 74 and a front screw cover 82. The configurations of the developer container 50E other than the difference are identical or similar to those of the developer container 50A according to the first embodiment. Hereinafter, a detailed description is made about the developer container 50E focusing on the different point. The screw 52 serves as the above-described developer transporter and also serves as a developer discharger which transports developer toward a discharge port 51*a* while rotating in a developer transport direction MG crossing or perpendicular to the rotation direction R1 of the rotary stirrer 53A.

The rotary shaft 54 and the rotary stirrer 53A (and a rotary support 55C and flexible blades 56 and 57) of this fourth variation are substantially the same as those of the first embodiment in shape, dimension, material, and holding and mounting manner of the flexible blades 56 and 57 on the rotary support 55C. The rotary shaft 54 and the rotary stirrer 53A of the fourth variation are driven to rotate in the rotation direction R1, i.e., a clockwise direction in FIGS. 16 to 18. The configuration in which the rotary shaft 54 and the rotary stirrer 53A are driven to rotate in the rotation direction R1, i.e., the clockwise direction in FIGS. 16 to 18, and the stirring and transport performance of developer contained in the developer container 50E are further expressed as follow. In other words, for the rotary stirrer 53A of this fourth variation, base end portions 56*b* and 57*b* of the flexible blades 56 and 57 are held with holding surfaces 55*g* and 55*h* of the rotary support 55C so that distal ends 56*a* and 57*a* extend downstream in the rotation direction R1. Thus, the flexible blades 56 and 57 enter the developer contained in the container body 51 ahead of end portions 55*a* and 55*b* which are fee ends of the rotary support 55C.

As illustrated in FIGS. 16 and 17, the screw 52 of this fourth variation is disposed at a position at which a portion of the screw 52 enters the inside of a rotation radius LR of each of the flexible blades 56 and 57 of the rotary stirrer 53A. In other words, the most peripheral portion of the screw 52 protrudes beyond an arc-shaped surface 51*c* toward an interior of a container inner wall 51*b* and is exposed to the interior of the container inner wall 51*b*. Such an arrangement allows an increase in the capacity of the container body 51. In other words, the developer containing capacity is increased by lowering a bottom face of the container body 51. In such a case, the screw 52 contacts the flexible blades 56 and 57 and stress is applied to the developer, thus facilitating generation of developer (toner) agglomerates.

As described above, the flexible blades 56 and 57 in this variation enter the developer contained in the container body 51 ahead of end portions 55*a* and 55*b* which are fee ends of the rotary support 55C and transport the developer so as to scoop the developer. Accordingly, the distal ends 56*a* and 57*a* of the flexible blades 56 and 57 might be caught in a recess of the screw 52. Hence, for this fourth variation, both axial end portions of the screw 52 are covered with the rear screw cover 74 and the front screw cover 82.

As illustrated in FIGS. 16, 17, and 19, when the rotary stirrer 53A rotates, the distal ends 56*a* and 57*a* of the flexible blades 56 and 57 contact the rear screw cover 74 and the front screw cover 82 and are bent. The flexible blades 56 and 57 have an axially-continuous, rectangle shape, and a middle of each of the flexible blades 56 and 57 is bent following the rectangle shape. Accordingly, the flexible blades 56 and 57 move over the screw 52 and rotate without contacting the screw 52 exposed between the rear screw cover 74 and the front screw cover 82. Such a configuration can suppress generation of developer (toner) agglomerates due to contact of the screw 52 and the flexible blades 56 and 57 while preventing the distal ends 56*a* and 57*a* of the flexible blades 56 and 57 from being caught in a recess of the screw 52.

The developer stirred and transported with the rotary stirrer 53A is transported toward a discharge port with an exposed portion of the screw 52. As illustrated in FIG. 20, a length Lc of an exposed portion of the screw 52 between the rear screw cover 74 and the front screw cover 82 is preferably greater than a length (La+Lb) of covered portions of the screw 52 with the rear screw cover 74 and the front screw cover 82. Such a configuration secures good discharge performance of developer.

According to this fourth variation, the above-described configuration gives an operational effect equivalent to the operational effect of the first embodiment. Additionally, the base end portions 56*b* and 57*b* of the flexible blades 56 and 57 are held with holding surfaces 55*g* and 55*h* of the rotary support 55C so that distal ends 56*a* and 57*a* extend downstream in the rotation direction R1. Thus, the flexible blades 56 and 57 enter the developer contained in the container body 51 ahead of end portions 55*a* and 55*b* which are fee ends of the rotary support 55C and transport the developer so as to scoop the developer. Such a configuration allows enhancement of the transport performance of developer and a reduction in the remaining amount of developer on replacement of the developer container. Therefore, it is possible to reduce the rigidity of the flexible blade, improve the performance of the rotary stirrer of stirring and transporting a developer having a bad liquidity, and avoid an increase of the rotation torque of the rotary stirrer at the same time.

[Fifth Variation]

Figure 21:
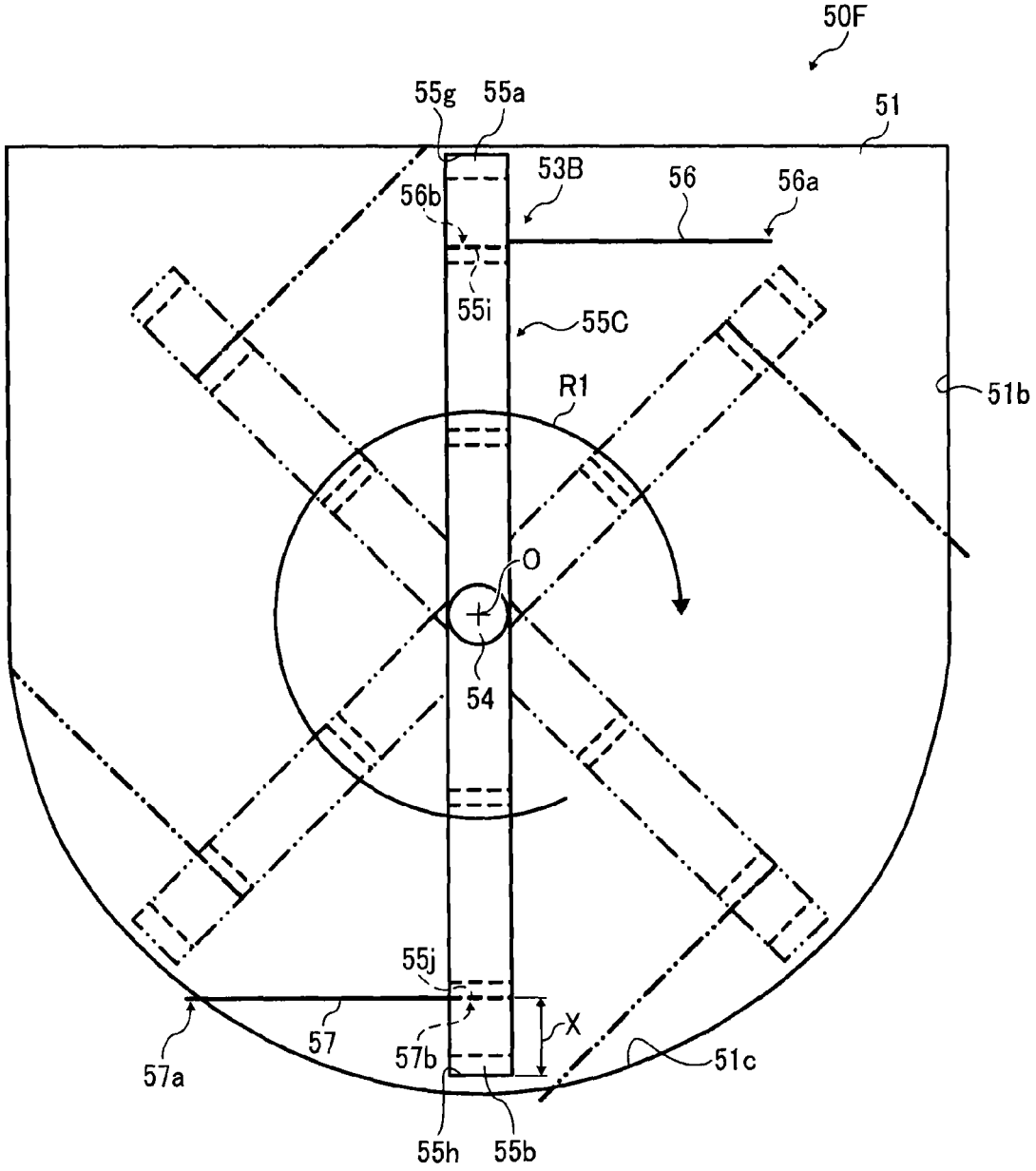
FIG. 21 is a schematic front view of a developer container according to a fifth variation.
Figure 22:
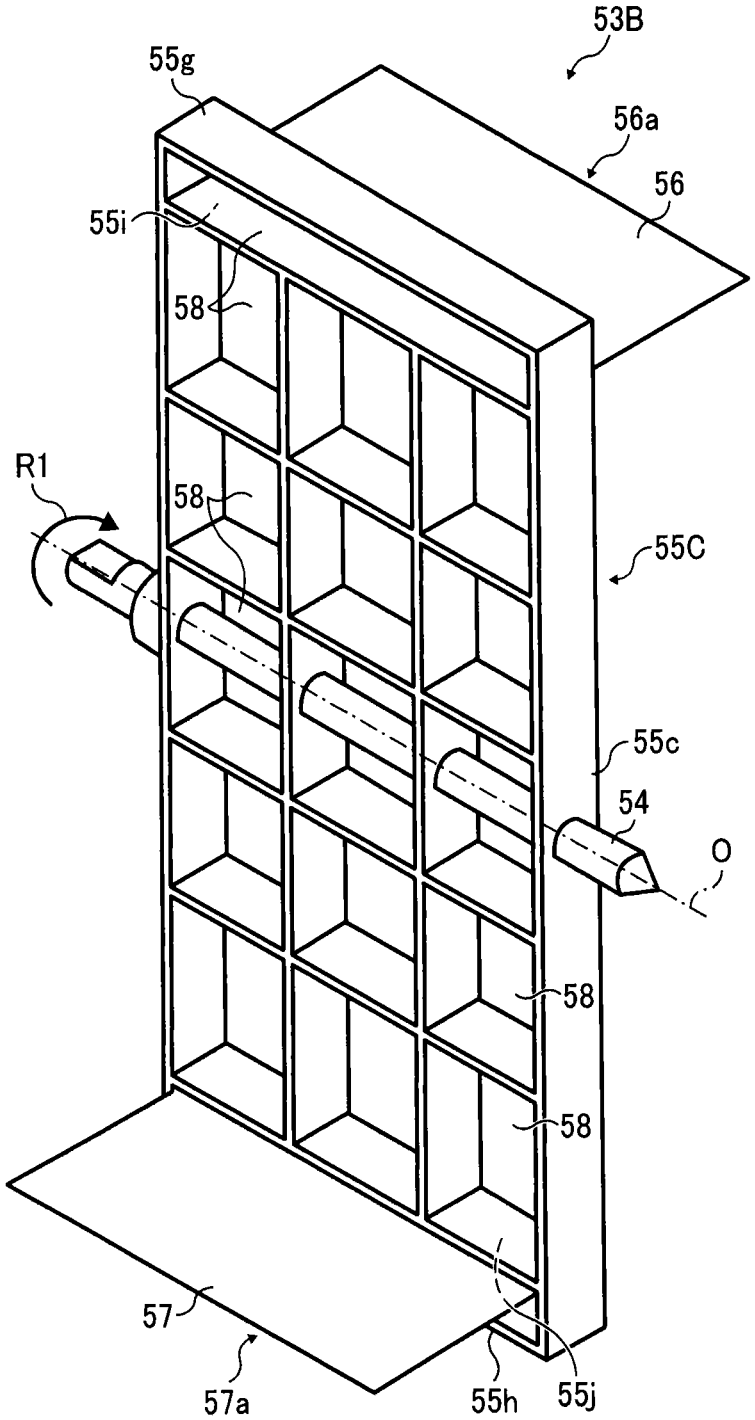
FIG. 22 is an outer perspective view of a rotary stirrer built in the developer container of FIG. 21.

FIGS. 21 and 22 illustrate a developer container 50F according to a variation (fifth variation) of the fourth variation. FIG. 21 is a schematic front view illustrating a configuration of the developer container 50F according to the fourth variation. FIG. 22 is an outer perspective view of a rotary stirrer 53B built in the developer container 50F of FIG. 21. The developer container 50F of the fourth variation is different from the developer container 50B of the first variation illustrated in FIGS. 11 and 12 mainly in that the rotary shaft 54 and the rotary stirrer 53B in the fifth variation rotate in a rotation direction R1 opposite the rotation direction R of the rotary shaft 54 and the rotary stirrer 53A of the developer container 50B and that a screw is covered with a rear screw cover and a front screw cover. The configurations of the developer container 50F other than the difference are identical or similar to those of the developer container 50B according to the first variation. Hereinafter, a detailed description is made about the developer container 50F focusing on the different point.

According to this fifth variation, the above-described configuration gives operational effects obtained in combination of the first variation and the fourth variation. In other words, according to the fifth variation, the above-described configuration gives the following operational effects, in addition to an operational effect equivalent to the operational effect of the fourth variation. For the rotary support 55C, a distance X (dimension) from the holding surface 55*h* to the holding surface 55*j* (or from the holding surface 55*g* to the holding surface 55*i*) can be arbitrarily set. Further, flexible blades having a greater free length can be attached by increasing the distance X. In a case where the flexible blade is restricted in a minimum thickness, there is only method of making the free length increase in order to reduce an attaching force of the flexible blade. In this case, an arbitrarily-determined distance X exerts an excellent effect. The base end portions 56*b* and 57*b* of the flexible blades 56 and 57 are held with holding surfaces 55*g* and 55*h* of the rotary support 55C, to which the distance X can be arbitrarily set, so that distal ends 56*a* and 57*a* extend downstream in the rotation direction R1. Thus, the flexible blades 56 and 57 enter the developer contained in the container body 51 ahead of end portions 55*a* and 55*b* that are fee ends of the rotary support 55C and transport the developer so as to scoop the developer. Such a configuration allows enhancement of the transport performance of developer and a reduction in the remaining amount of developer on replacement of the developer container. Therefore, it is possible to reduce the rigidity of the flexible blade, improve the performance of the rotary stirrer of stirring and transporting a developer having a bad liquidity, and avoid an increase of the rotation torque of the rotary stirrer at the same time.

[Sixth Variation]

Figure 23:
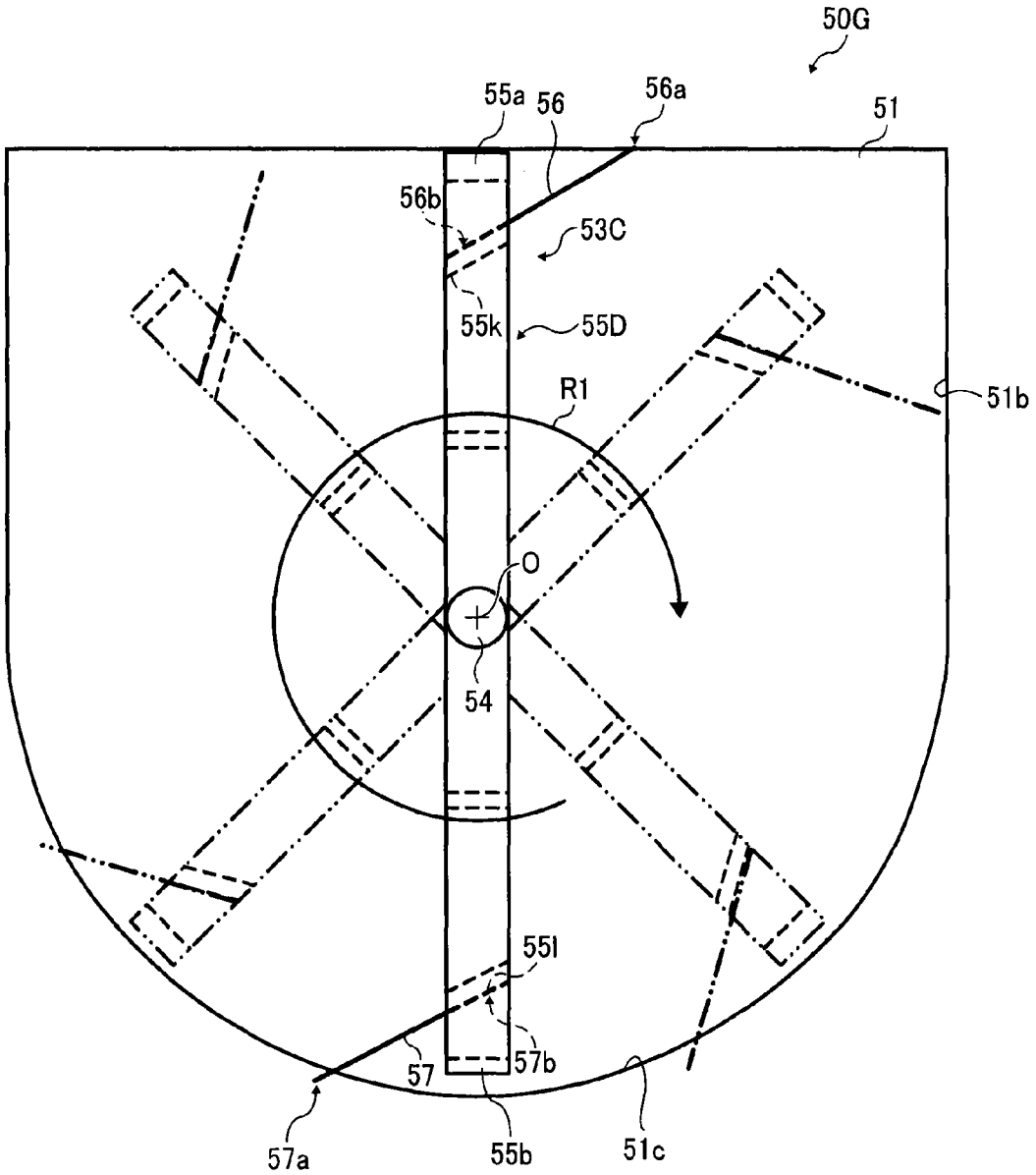
FIG. 23 is a schematic front view of a developer container according to a sixth variation.
Figure 24:
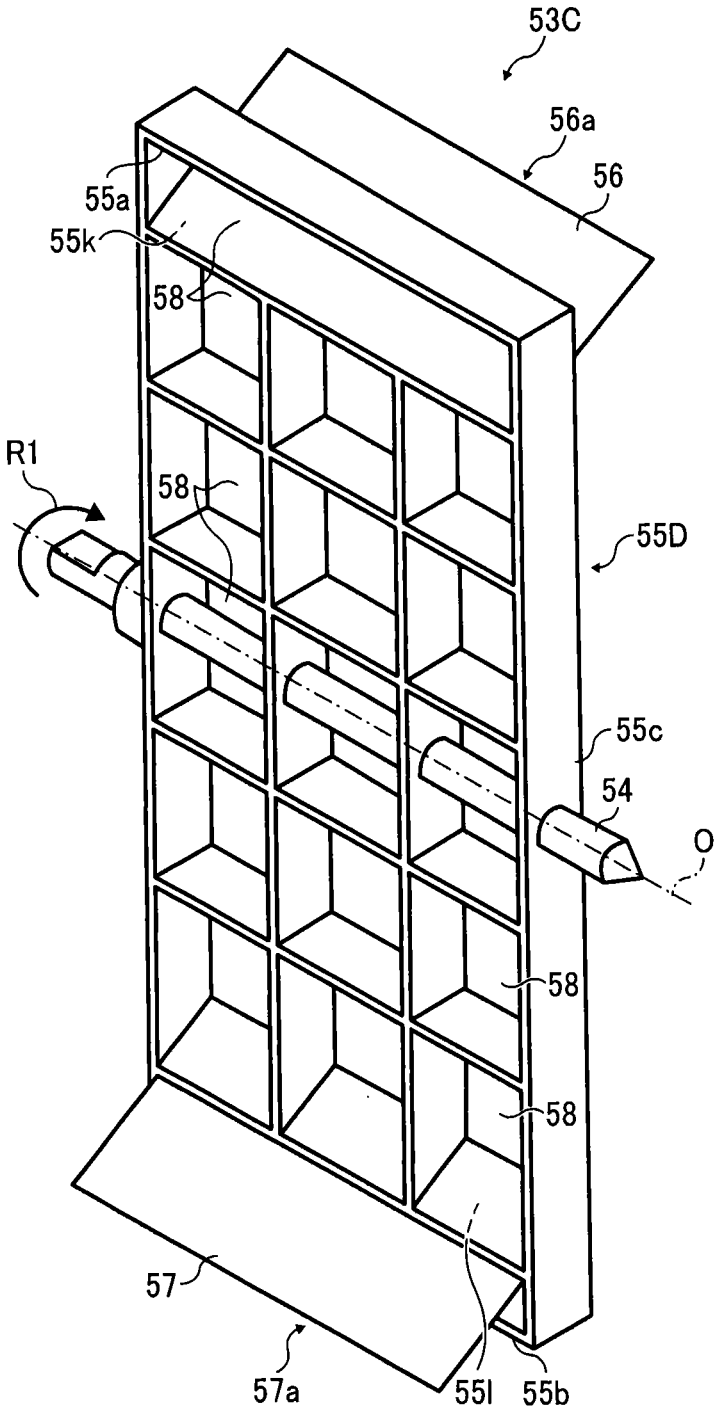
FIG. 24 is an outer perspective view of a rotary stirrer built in the developer container of FIG. 23.

FIGS. 23 and 24 illustrate a developer container 50G according to a variation (six variation) of the fifth variation.

FIG. 23 is a schematic front view illustrating a configuration of the developer container 50G according to the sixth variation. FIG. 24 is an outer perspective view of a rotary stirrer 53C built in the developer container 50G of FIG. 23. The developer container 50G of the sixth variation is different from the developer container 50C of the second variation illustrated in FIGS. 13 and 14 mainly in that a rotary shaft 54 and the rotary stirrer 53C in the sixth variation rotate in a rotation direction R1 opposite the rotation direction R of the rotary shaft 54 and the rotary stirrer 53C of the developer container 50C and that a screw is covered with a rear screw cover and a front screw cover. The configurations of the developer container 50G other than the difference are identical or similar to those of the developer container 50C according to the second variation. Hereinafter, a detailed description is made about the developer container 50G focusing on the different point.

Like the second variation illustrated in FIGS. 13 and 14, the rotary support 55D is different from the rotary support 55C in that holding surfaces 55*k* and 55*l* inclined with respect to the rotation direction R1 of the rotary support 55D to some degree are formed with respect to the holding surfaces 55*i* and 55*j* of the rotary support 55C. The holding surfaces 55*k* and 55*l* are formed with an inclination of 90 to 180 degrees with respect to the rotation direction R1 of the rotary support 55D. Then, the flexible blades 56 and 57 are attached to the inclined holding surfaces 55*k* and 55*l*.

In the sixth variation, with the flexible blades 56 and 57 attached to the inclined holding surfaces 55*k* and 55*l*, the transportation performance of the developer of the flexible blades 56 and 57 is improved, but the projected area in the rotation direction R is increased compared to the rotary support 55C of the fifth variation. Therefore, there is a trade-off with respect to the rotation torque loaded on the rotary stirrer 53C. This trade-off may be adjusted according to a required performance. According to the sixth variation, except for the above-described technical content, operational effects equivalent to those of the fifth variation can be obtained.

[Seventh Variation]

Figure 25:
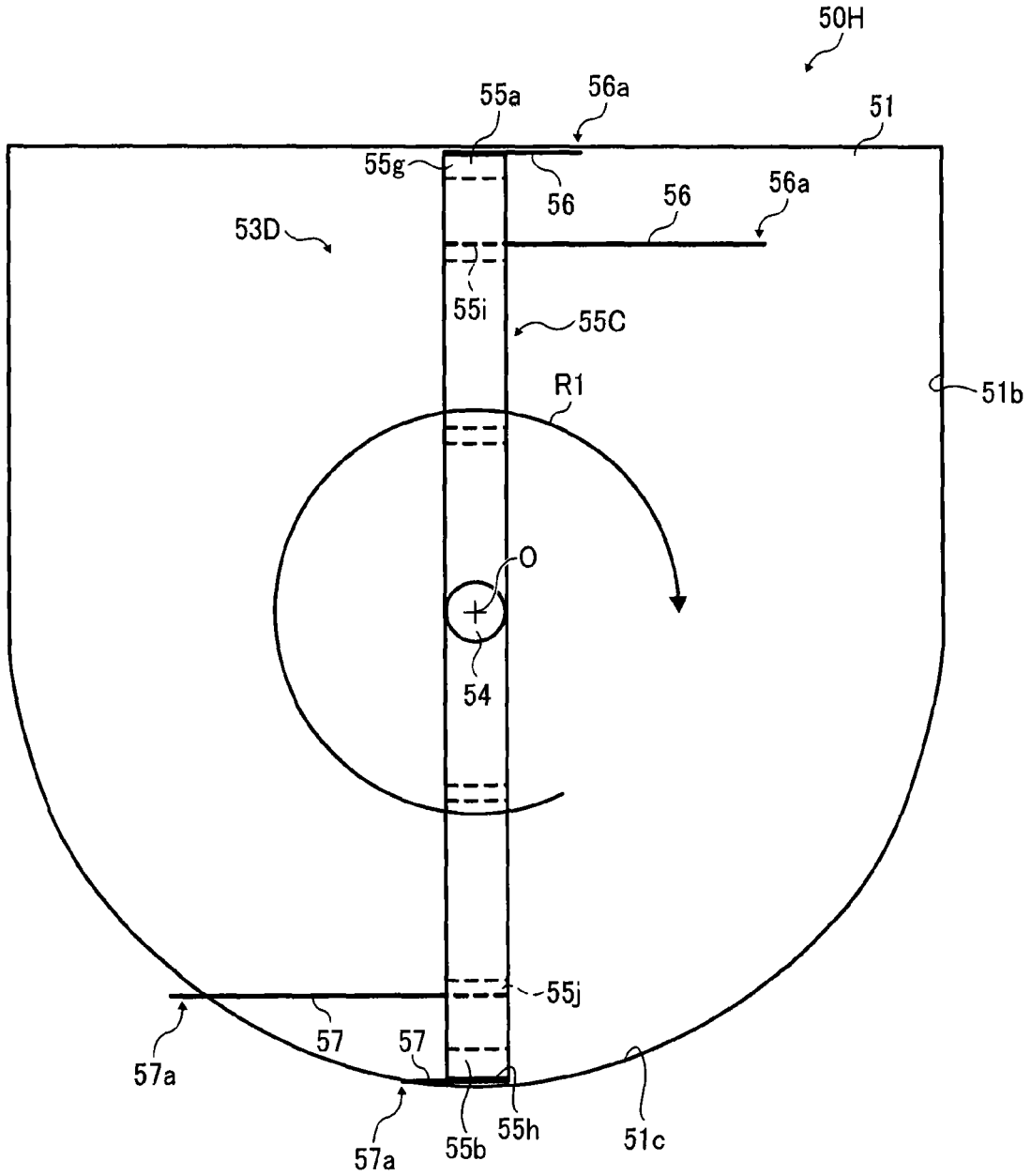
FIG. 25 is a schematic front view of a developer container according to a seventh variation.

FIG. 25 illustrates a developer container 50H according to a variation (seventh variation) of the fifth variation. FIG. 25 is a schematic front view illustrating a configuration of the developer container 50H according to the seventh variation. The developer container 50H of the seventh variation is different from the developer container 50D of the third variation illustrated in FIG. 15 mainly in that a rotary shaft 54 and a rotary stirrer 53D in the seventh variation rotate in a rotation direction R1 opposite the rotation direction R of the rotary shaft 54 and the rotary stirrer 53D of the developer container 50D and that a screw is covered with a rear screw cover and a front screw cover. The configurations of the developer container 50H other than the differences are identical or similar to those of the developer container 50D according to the third variation. Hereinafter, a detailed description is made about the developer container 50H focusing on the different point.

The seventh variation corresponds to a combination of the first fourth variation and the fifth variation. Three sheets of flexible blades 56 and 57 in total (on both holding surfaces at the distance X from the holding surface 55*h* to the holding surface 55*j* and from the holding surface 55*g* to the holding surface 55*i*) may be configured to be attached by combining, e.g., FIG. 17 and FIG. 21 based on the unique configuration of the rotary support 55C. Such a configuration can further improve the transportation performance of developer using three or more sheets of the flexible blades 56 and 57 having different lengths and shapes.

Here, before description of a second embodiment, increased and decreased states of rotation torque depending on rotary positions of a rotary stirrer 53 in a developer container 50 according to a comparative example is described with reference to FIGS. 26A and 26B.

Figure 26A:
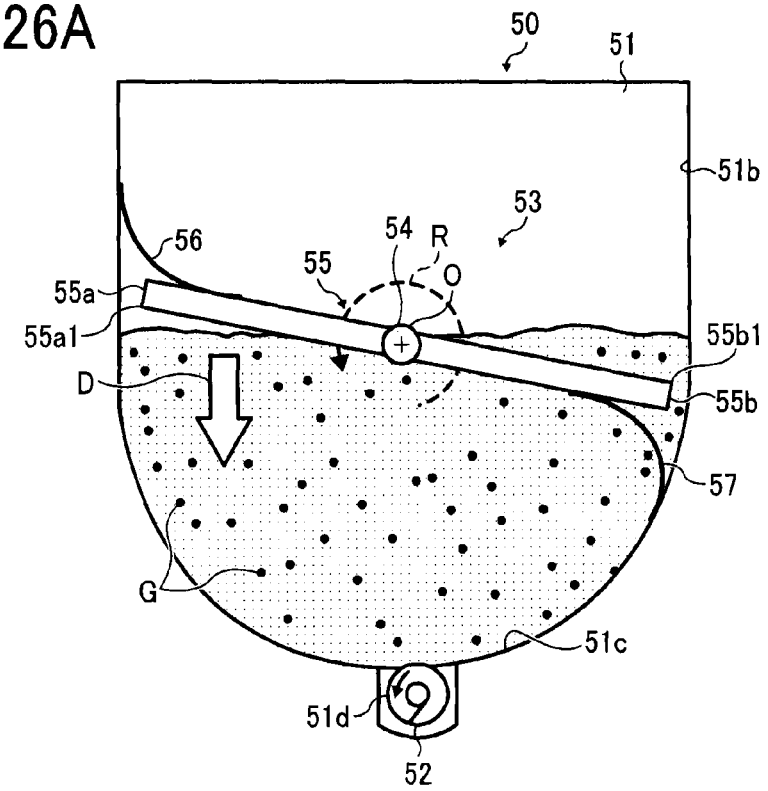
FIG. 26A is a cross-sectional front view of a rotary stirrer of a developer container according to a comparative example, in a state in which the rotary stirrer is at a substantially horizontal position.
Figure 26B:
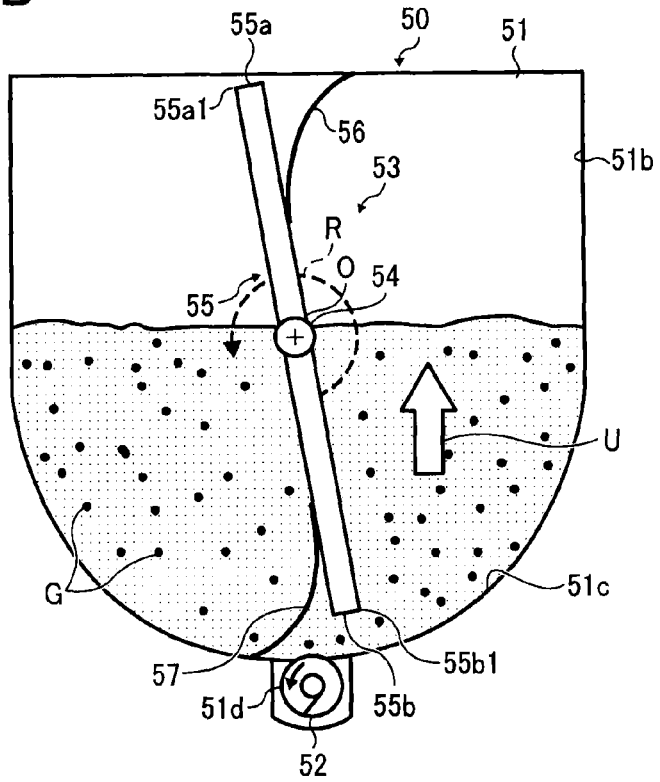
FIG. 26B is a cross-sectional front view of the rotary stirrer of FIG. 26A in a state in which the rotary stirrer is at a substantially-vertical position.

FIGS. 26A and 26B are schematic views of increased and decreased states of rotation torque depending on rotary positions of the rotary stirrer 53 in the developer container 50 according to the comparative example. FIG. 26A shows a state in which the rotary stirrer 53 is at a substantially horizontal position. FIG. 26B is a state in which the rotary stirrer 53 is at a substantially vertical position. For the rotary stirrer 53 illustrated in FIGS. 3 to 6 or FIG. 8, since a projected area in the rotation direction R of the rotary support 55 is large as can be seen in FIGS. 3 to 5 and FIGS. 7A, 7B, and 8, a load of the developer G on the rotary support 55 becomes larger when the developer G apparently increased in volume density is stirred. As a result, a side effect may arise that a rotation torque of the rotary support 55 and a rotation torque of the rotary stirrer 53 are apparently increased. In this case, in particular, if a portion of the rotary support 55 further away from the rotary shaft 54 in the centrifugal direction has a larger projected area, the load of the developer G to the rotary support 55 is greater on the principle of moment of force, thus significantly increasing the rotation torque of the rotary stirrer 53. As described above, if a projected area in the rotation direction R of the rotary stirrer 53 is large when the developer remarkably increased in the volume density is stirred by the flexible blade having a large rigidity, the rotation torque of the rotary stirrer 53 would be remarkably increased due to a resistance of the developer.

In particular, the rotation torque remarkably increases in the state in which the rotary stirrer 53 is at the substantially horizontal position illustrated in FIG. 26A. This is because, while the rotary stirrer 53 transports developer G (toner) downward as indicated by arrow D in FIG. 26A, developer G (toner) in a lower side of the developer container 50 is less likely to move due to the arc-shaped surface 51*c* of the container body 51. By contrast, when the rotary stirrer 53 is at the substantially vertical position as illustrated in FIG. 26B, the rotation torque of the rotary stirrer 53 is smaller than when the rotary stirrer 53 is at the substantially horizontal position. This is because developer G (toner) in an upper side of the developer container 50 is likely to move due to a hollow area having no toner in the container body 51 while the rotary stirrer 53 transports developer G (toner) upward as indicated by arrow U in FIG. 26B. Considering the above description together, the inventors of this application have found that the rotary support preferably has a framework shape with multiple through-openings so as to decrease the projected area of the portion of the rotary stirrer away from the rotary shaft 54. Then, a rotary stirrer according to the second embodiment of the present disclosure described herein is created. According to the second embodiment of this disclosure, an increase in rotation torque of the rotary stirrer or deformation of the rotary stirrer can be prevented.

[Second Embodiment]

A developer container 50I according to the second embodiment is described with reference to FIGS. 27A and 27B.

Figure 27A:
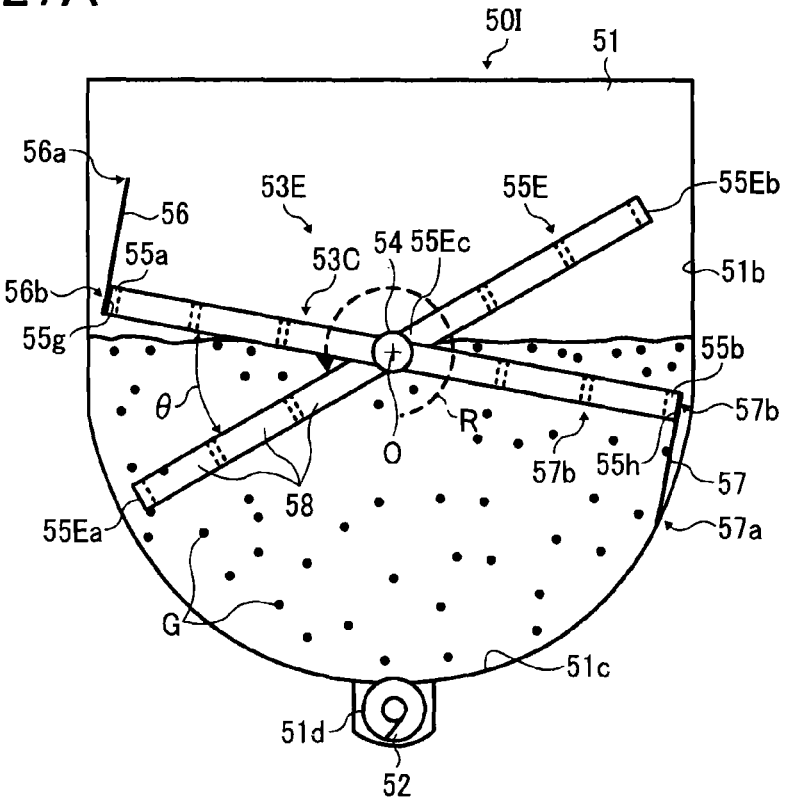
FIG. 27A is a schematic front view of a developer container according to a second embodiment of this disclosure.
Figure 27B:
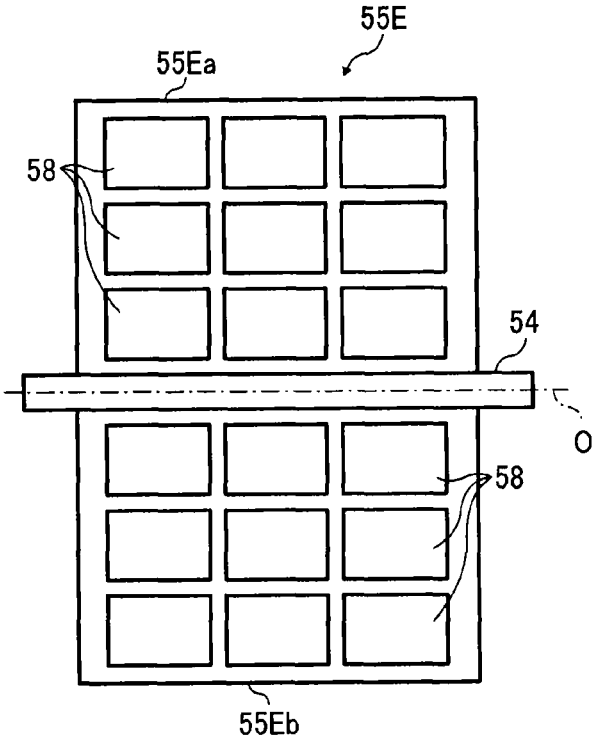
FIG. 27B is a side view of a shape and structure of a rotary support of a rotary stirrer built in the developer container according to the second embodiment.

FIGS. 27A and 27B are schematic views of the developer container 50I according to the second embodiment. FIG. 27A is a schematic front view of a configuration of the developer container 50I according to the second embodiment. FIG. 27B is a side view of a shape and structure of a rotary support of a rotary stirrer built in the developer container 50I.

FIG. 27A shows the developer container 50I according to the second embodiment. The developer container 50I of the second embodiment is different from the developer container 50A of the first embodiment illustrated in FIG. 9 in that the developer container 50I employs a rotary stirrer 53E instead of the rotary stirrer 53A. The configurations of the developer container 50I other than the difference are identical or similar to those of the developer container 50A according to the first embodiment. Hereinafter, a detailed description is made about the rotary stirrer 53E focusing on the different point.

The rotary stirrer 53E is different from the rotary stirrer 53A according to the first embodiment in that the rotary stirrer 53E employs a rotary support 55E in addition to a rotary support 55C. In other words, the rotary stirrer 53E includes the rotary support 55C rotatable with a rotary shaft 54, the rotary support 55E serving as a second rotary support rotatable with the rotary shaft 54, and flexible blades 56 and 57 held on both end portions of the rotary support 55C in the same manner as in FIG. 9.

The rotary shaft 54 and the rotary support 55E may be integrally formed with an appropriate resin for the sake of reduction in weight and cost down similarly to the first embodiment, or may be integrally configured with metal or resin. As described above, like the rotary shaft 54 and the rotary support 55C, the rotary shaft 54 and the rotary support 55E can be regarded as substantially a rigid body having a fully rigidity, and has stirring and loosening functions.

For the rotary support 55E, a base end 55Ec is integrally formed with the rotary shaft 54, and end portions 55Ea and 55Eb serving as free ends are disposed adjacent to container inner walls 51*b*. The rotary support 55E is a lattice member having multiple openings 58 across in a longitudinal direction of the rotary shaft 54. For the rotary support 55E, the multiple opening 58 are formed so that a projected area of the rotary support 55E in the rotation direction R1 is smaller than that of the rotary support 55C. The rotary support 55E is integrally formed with the rotary shaft 54 at a predetermined angle relative to the rotary support 55C. The rotary support 55E is formed in a shape having no surface perpendicular to the rotation direction R other than a lattice framework compared to the rotary support 55 of the comparative example (a shape of a smaller projected area in the rotation direction R1), and has an increased total area of the openings 58. Each of the rotary support 55C and the rotary support 55E is integrally mounted on the rotary shaft 54 at an angle of 90° or smaller as the predetermined angle. In the side view of FIG. 27B, each of the rotary support 55C and the rotary support 55E is symmetrical with respect to a center line (axis of symmetry) of a rotation center O of the rotary shaft 54. As described above, each of the rotary support 55C and the rotary support 55E has a lattice shape except for holding portions on which the flexible blades 56 and 57 are attached, and has a smaller projected area in the rotation direction R1. Such a configuration allows a significant reduction in rotation torque during stirring of developer.

The end portions 55Ea and 55Eb serving as free ends of the rotary support 55E are preferably configured such that a maximum length in the rotation radius direction is extended up to the container inner wall 51*b* and the arc-shaped surface 51*c* to an extent that the rotary support 55E does not contact the container inner wall 51*b* and the arc-shaped surface 51*c*. Specifically, the distance (gap) between the arc-shaped surface 51*c* (the bottom of the container) and each of the end portions 55Ea and 55Eb of the rotary support 55C and the end portions 55Ea and 55Eb of the rotary support 55E is preferably set to 0.5 to 5 mm. In addition, a rotational trajectory shape of each of the end portions 55Ea and 55Eb of the rotary support 55C and the end portions 55Ea and 55Eb of the rotary support 55E is formed to substantially match the internal shape of the container body 51 to reduce the distance (gap).

An operation of the second embodiment is described below with further descriptions of the above-described configuration. As described above, each of the rotary support 55C and the rotary support 55E has a lattice shape except for holding portions on which the flexible blades 56 and 57 are attached, and has a smaller projected area in the rotation direction R1. Such a configuration allows a significant reduction in rotation torque of, in particular, the rotary support 55E during stirring of developer. One reason of employing the rotary support 55E having a smaller projected area in the rotation direction R1 is to loosen developer having a significantly-increased bulk density. As described above, such an increase in bulk density may be caused by micro vibration, and solved by stirring and loosening the developer (toner). Of the rotary support 55C and the rotary support 55E, in particular, the rotary support 55E performs the loosening of the developer. The rotary support 55E has no flexible blades 56 and 57 and can have a smaller projected area in the rotation direction R1, thus allowing a reduction in counterforce received from the developer.

As illustrated in FIG. 27A, when the rotary stirrer 53E in the second embodiment stirs and transports developer G from the substantially horizontal position, a large torque occurs. Hence, an angle θ of the rotary support 55E having a smaller projected area in the rotation direction R1 relative to the rotary support 55C having a greater projected area with the flexible blades 56 and 57 is set to 90° or smaller. For an angle θ greater than 90°, when the rotary support 55C having the greater projected area in the rotation direction R1 is left in the substantially horizontal position and then rotated, developer G at a lower side of the rotary support 55C may not be loosened, thus increasing the rotation torque. Hence, the angle θ of the rotary support 55C relative to the rotary support 55E is set to 90° or smaller. Such a configuration allows the rotary support 55E to previously loosen the developer G at the lower side of the rotary support 55C, thus reducing an increase in rotation torque of the rotary stirrer 53E. As described above, before the flexible blades 56 and 57 of the rotary support 55C having a greater projected area transports developer G, the rotary support 55E having a smaller projected area and subsequently the rotary support 55C having the greater projected area loosen the developer G through the openings 58. Such a configuration reduces the counterforce which the rotary support 55C having the greater projected area receives from the developer G, thus reducing an increase in rotation torque.

In another viewpoint, since the rotary support 55C and the rotary support 55E have lattice shape, it appears that the stirring performance of developer might decrease. However, to supplement the stirring performance, the flexible blades 56 and 57 are provided with the rotary support 55C. First, before the flexible blades 56 and 57 transport developer, as described above, the rotary support 55E and subsequently the rotary support 55C passes the developer G stored in the container body 51 to loosen the developer G. Such a configuration facilitates transportation of the developer, and the flexible blades 56 and 57 passing thereafter can transport the developer G to the screw 52 against the resistance of the developer G. Thus, the flexible blades 56 and 57 can complement the stirring performance of the rotary support 55C by an amount at which the stirring performance of the rotary support 55C is lower than the comparative example. The rotary support 55E also disperses the rotation torque, thus suppressing a local increase in rotation torque depending on the rotation angle of the rotary stirrer 53E.

As described above, the configuration according to the second embodiment can reduce the rigidity of the flexible blade, improve the performance of the rotary stirrer of stirring and transporting a developer having a bad fluidity, and avoid an increase of the rotation torque of the rotary stirrer and deformation of the rotary stirrer at the same time.

Under a technical concept similar to the second embodiment, the rotary support 55E serving as the second rotary support rotatable with the rotary shaft 54 may be added to any of the above-described first to seven variations.

The rotary stirrer according to any of the above-described embodiments and variations has a framework structure with rigidity and hardness enough to achieve functions of loosening and stirring the developer, and therefore can be called a rigid-body stirrer.

Hitherto, the description has been made about the exemplary embodiments of the present disclosure, but the present disclosure is not limited to the related specific embodiments. Further, the present disclosure is not limited to the above description, and various modifications and changes can be made within a scope not departing from the spirit of the present disclosure described in claims. For example, the image forming apparatus to which the present disclosure is applied is not limited to the above-mentioned color printer, and other types of the image forming apparatuses may be employed. In other words, the image forming apparatus to which the present disclosure is applied may be a copier, a facsimile machine, a plotter, a multi-functional peripheral thereof, or a multi-functional peripheral such as a monochrome related to these apparatuses. In the above-described embodiments and variations, the examples in which flexible blades are mounted on both end portions of the rotary stirrer via the rotary shaft are described. However, a flexible blade may be provided at only one side of the rotary stirrer.

For example, the first embodiment may be appropriately combined with any of the first to seventh variations. In addition, as the developer contained in the developer container, a well-known developer such as a two-component developer in which the toner and the carrier are included may be employed in addition to a one-component developer made of the toner as a main component (in this case, the developer container is also called "toner cartridge").

The effects in the above-described embodiments and variations of this disclosure are examples listed as the most excellent effects, and effects of the claimed invention are not limited to those recited in the above-described embodiments and variations.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A developer container, comprising:

a container body to contain developer and having a discharge port through which the developer is discharged to an outside of the container body;

a rotary shaft;

a rotary stirrer including a rotary support and to rotate about the rotary shaft to stir and transport the developer within a storage chamber; and a developer discharger which includes a screw to transport the developer from the storage chamber to the discharge port, a rotational axis of the screw being below the rotary shaft, the rotary support including a base end rotatable integrally with the rotary shaft, a free end spaced away from an inner wall of the container body, and a holding surface at the free end or at a position shifted toward the rotary shaft away from the free end, the holding surface being parallel to or inclined relative to a rotation direction of the rotary support; and a flexible blade including a base end portion held on the holding surface and a distal end to contact the inner wall of the container body at a region below the rotary shaft which is an arc-shaped surface, the distal end further to transport the developer to the discharge port.

2. The developer container according to claim 1, wherein the rotary support has a lattice shape including multiple openings in a longitudinal direction of the rotary shaft.

3. The developer container according to claim 2, further comprising another lattice-shaped rotary support disposed at a predetermined angle relative to the rotary support, the another lattice-shaped rotary support having a base end rotatable with the rotary shaft and a free end spaced away from the inner wall of the container body, the another lattice-shaped rotary support including multiple openings in a longitudinal direction of the rotary shaft.

4. The developer container according to claim 3, wherein the another lattice-shaped rotary support has a smaller projected area in the rotation direction than the rotary support.

5. The developer container according to claim 3, wherein the predetermined angle is 90° or smaller.

6. The developer container according to claim 1, wherein the base end portion of the flexible blade is held on the holding surface with the distal end extending downward in the rotation direction, the base end to enter the developer in the container body ahead of the distal end.

7. The developer container according to claim 6, wherein:

the developer discharger is at least partially disposed within a rotation radius of the rotary stirrer, the developer container further comprising a cover covering a portion of the developer discharger, the flexible blade being deformable on contacting the cover and rotatable over the developer discharger.

8. The developer container according to claim 1, wherein a gap between the distal end and a bottom of the inner wall is 0.5 mm to 5 mm.

9. The developer container according to claim 1, wherein a shape of a rotational trajectory of the distal end substantially matches a shape of the inner wall within an extent that the distal end does not contact the inner wall.

10. The developer container according to claim 1, wherein a length of the flexible blade from the holding surface to the distal end is a length at which the distal end contacts the inner wall or digs the inner wall in a range greater than zero and not greater than 20 mm.

11. The developer container according to claim 1, wherein a shape of a rotational trajectory of the flexible blade substantially matches a shape of the inner wall.

12. The developer container according to claim 1, wherein the rotary support includes holding surfaces at plural positions, and a distance from one of the holding surfaces to the free end is selectable.

13. The developer container according to claim 12, wherein the flexible blade includes two blade members, and each of the blade members is held on the holding surface disposed at a distance away from a corresponding one of opposed free ends of the rotary support.

14. The developer container according to claim 13, wherein the blade members are different in shape.

15. The developer container according to claim 12, wherein the flexible blade includes three or more blade members held on the holding surface at the free end or the holding surfaces disposed away from the free end.

16. The developer container according to claim 1, wherein the flexible blade includes two blade members, and each of the blade members is held on a corresponding one of opposed free ends of the rotary support.

17. The developer container according to claim 1, wherein the flexible blade is a polyethylene-terephthalate film having a thickness of 50 μm to 200 μm and a free length protruding beyond the holding surface is 5 mm or greater.

18. The developer container according to claim 1, wherein the flexible blade is a polyurethane film having a thickness of 1 mm or greater and a free length protruding beyond the holding surface is 5 mm or greater.

19. A developer replenisher, comprising:

the developer container according to claim 1 which contains the developer to be supplied to a developing device and includes the rotary stirrer, and a mount to detachably mount the developer container.

20. An image forming apparatus comprising:

an image bearer to bear a latent image thereon;

the developing device to develop the latent image borne on the image bearer using the developer; and the developer replenisher according to claim 19 which supplies the developer to the developing device.

* * * * *